US012454806B2

(12) United States Patent
Igarashi et al.

(10) Patent No.: US 12,454,806 B2
(45) Date of Patent: Oct. 28, 2025

(54) WORK MACHINE

(71) Applicant: HITACHI CONSTRUCTION MACHINERY CO., LTD., Tokyo (JP)

(72) Inventors: Teruki Igarashi, Tsuchiura (JP); Akihiro Narazaki, Tsukuba (JP); Shuuichi Meguriya, Ishioka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 916 days.

(21) Appl. No.: 17/437,902

(22) PCT Filed: Sep. 8, 2020

(86) PCT No.: PCT/JP2020/034010
§ 371 (c)(1),
(2) Date: Sep. 10, 2021

(87) PCT Pub. No.: WO2021/065384
PCT Pub. Date: Apr. 8, 2021

(65) Prior Publication Data

US 2022/0145580 A1 May 12, 2022

(30) Foreign Application Priority Data

Sep. 30, 2019 (JP) ..... 2019-180334

(51) Int. Cl.
*E02F 3/43* (2006.01)
*E02F 9/20* (2006.01)
(Continued)

(52) U.S. Cl.
CPC ..... *E02F 3/437* (2013.01); *E02F 9/2029* (2013.01); *E02F 9/2264* (2013.01); *E02F 9/245* (2013.01); *E02F 9/265* (2013.01)

(58) Field of Classification Search
CPC ..... E02F 3/437; E02F 9/2029; E02F 9/2264; E02F 9/245; E02F 9/265; E02F 3/435;
(Continued)

(56) References Cited

U.S. PATENT DOCUMENTS 10,858,804 B2 * 12/2020 Takeuchi ..... E02F 3/435
11,536,004 B2 * 12/2022 Wu ..... E02F 9/2029
(Continued)

FOREIGN PATENT DOCUMENTS

CN 105992850 A 10/2016
EP 3604684 A1 2/2020
(Continued)

OTHER PUBLICATIONS

China Construction Machinery, C240 Excavator with CE—Features & Specifications, 2018 (Year: 2018).*
(Continued)

*Primary Examiner* — Ramya P Burgess
*Assistant Examiner* — Preston Jay Miller
(74) *Attorney, Agent, or Firm* — Mattingly & Malur, PC

(57) ABSTRACT

A work machine includes a work device having a boom, an arm, and work equipment and a controller that sets a target surface, and calculates a work equipment-to-target surface distance on the basis of signals from a position sensor and a posture sensor, and carries out control to decelerate the arm to keep the work equipment from excavating ground beyond the target surface when the work equipment-target surface distance has become shorter than a predetermined distance. The controller determines whether there is a possibility that the work equipment enters the target surface when operation of the arm is carried out based on the set target surface and the position sensor and posture sensor signals, and does not carry out the deceleration control when the work equipment-to-target surface distance is shorter than the predetermined
(Continued)

distance and it is determined there is no possibility that the work equipment enters the target surface.

5 Claims, 21 Drawing Sheets

(51) Int. Cl.
*E02F 9/22* (2006.01)
*E02F 9/24* (2006.01)
*E02F 9/26* (2006.01)

(58) Field of Classification Search
CPC ..... E02F 9/2012; E02F 9/2033; E02F 9/2203; E02F 9/2285; E02F 9/2296; E02F 9/262; E02F 9/20; E02F 9/22; E02F 3/43
USPC ..... 701/50
See application file for complete search history.

(56) References Cited

U.S. PATENT DOCUMENTS

| | | | | |
|---|---|---|---|---|
| 2014/0343820 | A1 | 11/2014 | Kim | |
| 2016/0097184 | A1* | 4/2016 | Matsuyama | E02F 9/2033 701/50 |
| 2017/0268198 | A1* | 9/2017 | Shimano | E02F 3/32 |
| 2019/0119886 | A1* | 4/2019 | Izumi | E02F 9/20 |
| 2020/0232179 | A1 | 7/2020 | Sasaki et al. | |
| 2020/0232186 | A1* | 7/2020 | Nakano | F15B 21/087 |
| 2020/0248430 | A1* | 8/2020 | Ito | E02F 9/265 |
| 2022/0170234 | A1* | 6/2022 | Nakano | E02F 9/2041 |

FOREIGN PATENT DOCUMENTS

| | | | | |
|---|---|---|---|---|
| JP | 08-311918 | A | 11/1996 | |
| JP | 2001-032331 | A | 2/2001 | |
| JP | 2018-155077 | A | 10/2018 | |
| JP | 2019-151973 | A | 9/2019 | |
| KR | 20180136518 | A * | 12/2018 | E02F 3/432 |

OTHER PUBLICATIONS

Wikipedia, Law of Cosines, 2018 (Year: 2018).*
Wikipedia, Tangent lines to circles, 2017 (Year: 2017).*
English Translation of KR-20180136518-A (Year: 2018).*
Extended European Search Report received in corresponding European Application No. 20872650.5 dated Sep. 25, 2023.
International Search Report of PCT/JP2020/034010 dated Nov. 17, 2020.
International Preliminary Report on Patentability received in corresponding International Application No. PCT/JP2020/034010 dated Apr. 14, 2022.
Chinese Office Action received in corresponding Chinese Application No. 202080014705.2 dated Apr. 25, 2022.

* cited by examiner

WORK MACHINE

TECHNICAL FIELD

The present invention relates to a work machine.

BACKGROUND ART

As a work machine such as a hydraulic excavator, what has a machine control (hereinafter, described as MC as appropriate) function that assists operation of a front work device by an operator is known (refer to patent document 1). In patent document 1, area setting means that sets an area in which the tip of a bucket can move and an area limiting excavation controller that carries out deceleration control to reduce the movement velocity of an arm when the distance from a boundary of the set area (target surface) to the tip of the bucket becomes shorter than a predetermined threshold on the basis of the position and posture of the front work device are described.

PRIOR ART DOCUMENT

Patent Document

Patent Document 1: JP-1996-311918-A

SUMMARY OF THE INVENTION

Problem to be Solved by the Invention

In the technique described in patent document 1, in the case in which the distance from the target surface to the tip of the bucket is shorter than the predetermined threshold, the movement velocity of the arm is reduced also when entry of the bucket into the target surface is not envisaged. Therefore, there is a fear of the lowering of the efficiency of work by the work machine.

The present invention aims at improving the efficiency of work by a work machine.

Means for Solving the Problem

A work machine according to one aspect of the present invention includes a machine body, an articulated work device that has a boom, an arm, and work equipment and is attached to the machine body, an operation device that operates the machine body and the work device, a position sensor that senses the position of the machine body, and a posture sensor that senses posture of the work device. The work machine includes also a controller that sets a target surface, and calculates a work equipment-to-target surface distance that is a distance from the work equipment to the target surface on the basis of signals from the position sensor and the posture sensor, and controls the boom and carries out deceleration control to decelerate the arm to keep the work equipment from excavating ground beyond the target surface when operation of the arm is carried out by the operation device and the work equipment-to-target surface distance has become shorter than a predetermined distance. The controller is configured to determine whether or not there is a possibility that the work equipment enters the target surface when operation of the arm is carried out, on the basis of the target surface that is set and the signals from the position sensor and the posture sensor, and the controller is configured not to carry out the deceleration control even when the work equipment-to-target surface distance is shorter than the predetermined distance in the case in which it is determined that there is no possibility that the work equipment enters the target surface.

Advantages of the Invention

According to the present invention, the efficiency of work by a work machine can be improved.

MODES FOR CARRYING OUT THE INVENTION

Embodiments of the present invention will be described below by using the drawings. In the following, a hydraulic excavator including a bucket 10 as work equipment (attachment) at the tip of a work device will be exemplified. However, the present invention may be applied to a work machine including an attachment other than the bucket. Moreover, application to a work machine other than the hydraulic excavator is also possible as long as the work machine is what includes an articulated work device having a boom, an arm, and work equipment.

Furthermore, in the present specification, regarding the meaning of a word, "on," "upper side," and "lower side," used with a term showing a certain shape (for example, target surface, design surface, or the like), "on" means the "surface" of this certain shape, and "upper side" means a "position higher than the surface" of this certain shape, and "lower side" means a "position lower than the surface" of this certain shape. Moreover, in the following description, when plural elements exist as the same constituent elements, alphabets are often given to the tail ends of characters (numerals). However, these alphabets are omitted and these plural constituent elements are collectively represented in some cases. For example, when three pumps 300*a*, 300*b*, and 300*c* exist, they are collectively represented as pumps 300.

First Embodiment

—Overall Configuration of Hydraulic Excavator—

Figure 1:
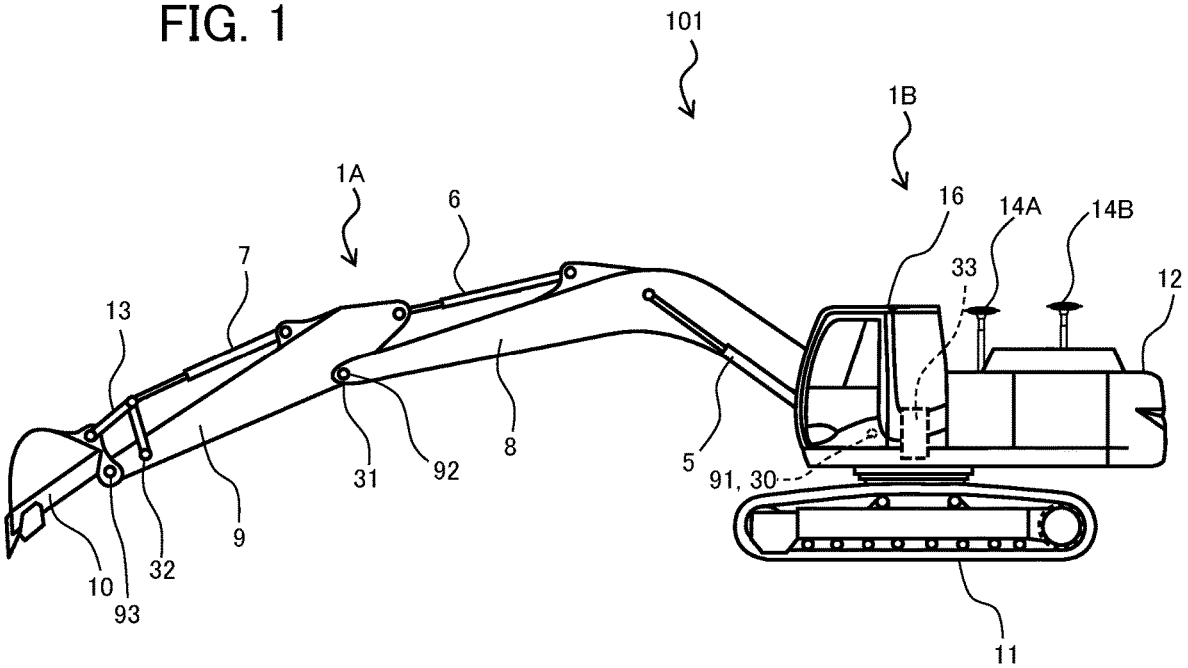
FIG. 1 is a side view of a hydraulic excavator.
Figure 2:
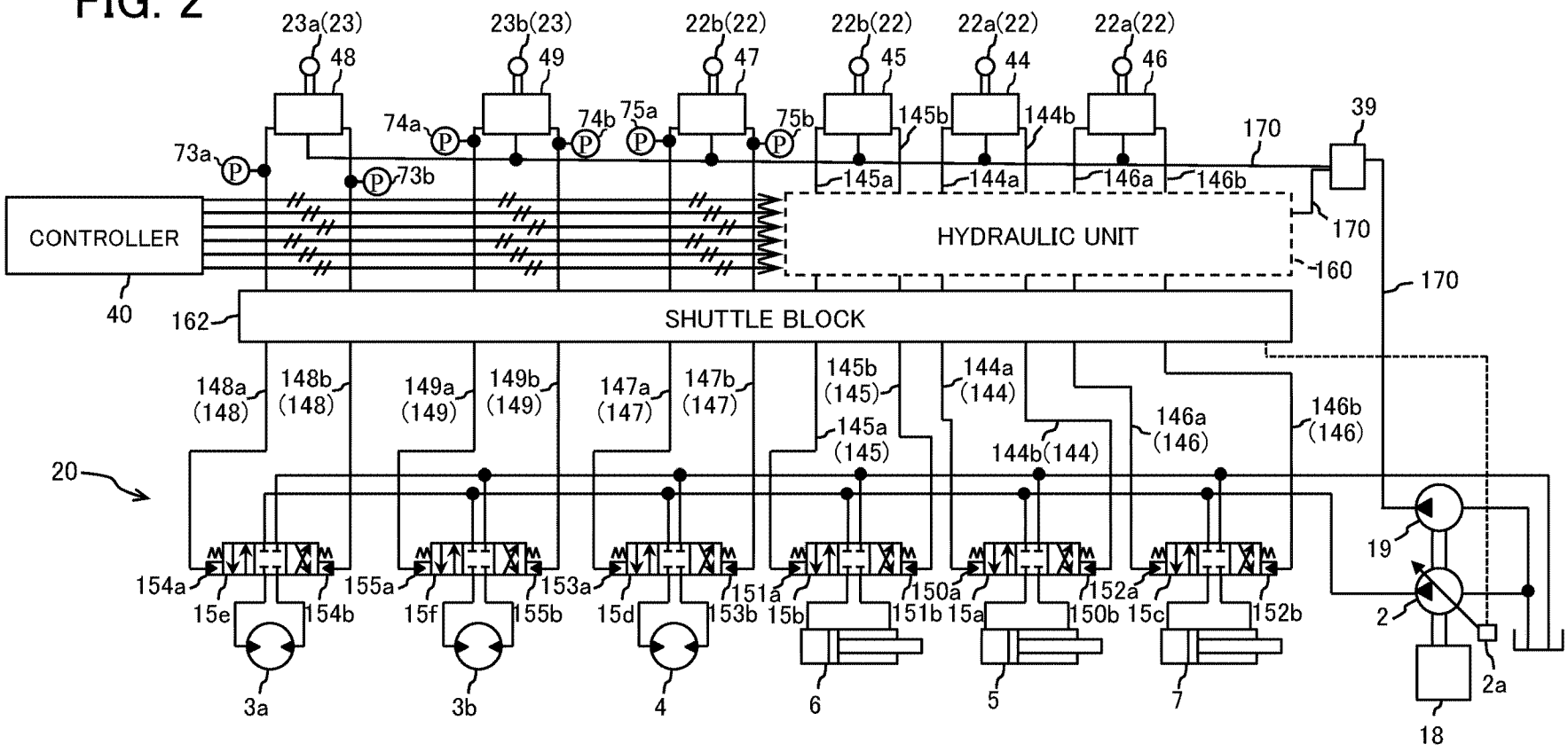
FIG. 2 is a diagram illustrating a controller of the hydraulic excavator together with hydraulic drive apparatus.
Figure 3:
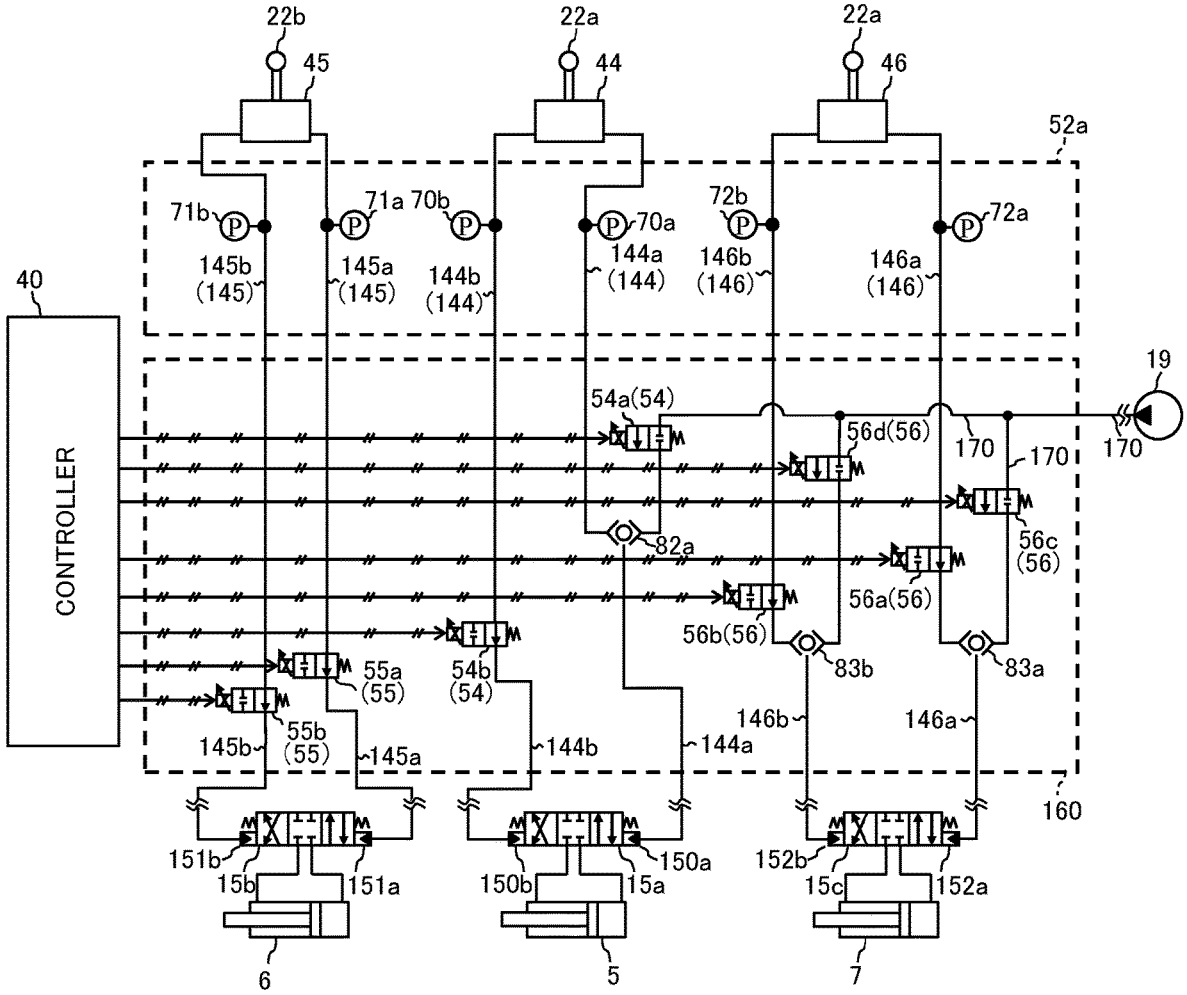
FIG. 3 is a detail view of a hydraulic unit illustrated in FIG. 2.

FIG. 1 is a side view of a hydraulic excavator according to an embodiment of the present invention. FIG. 2 is a diagram illustrating a controller of the hydraulic excavator according to the embodiment of the present invention together with hydraulic drive apparatus. FIG. 3 is a detail view of a hydraulic unit 160 illustrated in FIG. 2.

As illustrated in FIG. 1, a hydraulic excavator 101 includes a machine body 1B and an articulated front work device (hereinafter, represented simply as work device) 1A attached to the machine body 1B. The machine body 1B has a lower track structure 11 that travels by left and right travelling hydraulic motors 3*a* and 3*b* (see FIG. 2) and an upper swing structure 12 that is attached onto the lower track structure 11 and swings by a swing hydraulic motor 4 (see FIG. 2).

In the work device 1A, plural driven members (boom 8, arm 9, and bucket 10) that are each pivoted in the perpendicular direction are joined in series. The base end part of the boom 8 is pivotally supported at the front part of the upper swing structure 12 with the interposition of a boom pin 91. The arm 9 is pivotally joined to the tip part of the boom 8 with the interposition of an arm pin 92 and the bucket 10 as work equipment is pivotally joined to the tip part of the arm 9 with the interposition of a bucket pin 93. The boom 8 is driven by a hydraulic cylinder (hereinafter, represented also as boom cylinder 5) that is an actuator. The arm 9 is driven by a hydraulic cylinder (hereinafter, represented also as arm cylinder 6) that is an actuator. The bucket 10 is driven by a hydraulic cylinder (hereinafter, represented also as bucket cylinder 7) that is an actuator.

A boom angle sensor 30 is attached to the boom pin 91 and an arm angle sensor 31 is attached to the arm pin 92 and a bucket angle sensor 32 is attached to a bucket link 13 such that pivot angles $\alpha$, $\beta$, and $\gamma$ (see FIG. 4) of the boom 8, the arm 9, and the bucket 10 can be measured. A machine body inclination angle sensor 33 that senses an inclination angle $\theta$ (see FIG. 4) of the upper swing structure 12 (machine body 1B) with respect to a reference plane (for example, horizontal plane) is attached to the upper swing structure 12. The angle sensors 30, 31, and 32 can be each replaced by an angle sensor that can sense an inclination angle with respect to a reference plane (horizontal plane) (that is, ground angle).

In a cab 16 disposed in the upper swing structure 12, an operation device 48 (FIG. 2) that has a travelling right lever 23*a* (FIG. 2) and is for operating the travelling right hydraulic motor 3*a* (lower track structure 11), an operation device 49 (FIG. 2) that has a travelling left lever 23*b* (FIG. 2) and is for operating the travelling left hydraulic motor 3*b* (lower track structure 11), operation devices 44 and 46 (FIG. 2) that share an operation right lever 22*a* (FIG. 2) and are for operating the boom cylinder 5 (boom 8) and the bucket cylinder 7 (bucket 10), and operation devices 45 and 47 (FIG. 2) that share an operation left lever 22*b* (FIG. 2) and are for operating the arm cylinder 6 (arm 9) and the swing hydraulic motor 4 (upper swing structure 12) are set. Hereinafter, the travelling right lever 23*a* and the travelling left lever 23*b* are collectively represented also as the operation lever 23 and the operation right lever 22*a* and the operation left lever 22*b* are collectively represented also as the operation lever 22.

In the upper swing structure 12, an engine 18 (see FIG. 2) that is a prime mover is mounted. As illustrated in FIG. 2, the engine 18 drives a main pump 2 and a pilot pump 19 that are hydraulic pumps. The main pump 2 is a pump of the variable displacement type in which the capacity is controlled by a regulator 2*a* and the pilot pump 19 is a pump of the fixed displacement type. In the present embodiment, a shuttle block 162 is disposed in the middle of pilot lines 144 to 149. Hydraulic signals output from the operation devices 44 to 49 are input also to the regulator 2*a* through this shuttle block 162. Although the detailed configuration of the shuttle block 162 is omitted, the hydraulic signals are input to the regulator 2*a* through the shuttle block 162 and the delivery rate of the main pump 2 is controlled according to these hydraulic signals.

A lock valve 39 is disposed on a pump line 170 that is a delivery line of the pilot pump 19. The downstream side of the lock valve 39 in the pump line 170 is made to branch into plural lines and these lines are connected to the operation devices 44 to 49 and the respective valves in the hydraulic unit 160 for controlling the work device 1A. The lock valve 39 is a solenoid selector valve in the present example and an electromagnetic drive part thereof is electrically connected to a position sensor of a gate lock lever (not illustrated)

disposed in the cab 16 of the upper swing structure 12. The position of the gate lock lever is sensed by the position sensor and a signal according to the position of the gate lock lever is input from the position sensor to the lock valve 39. When the position of the gate lock lever exists at a lock position, the lock valve 39 closes and the pump line 170 is interrupted. When the position of the gate lock lever exists at a lock release position, the lock valve 39 opens and the pump line 170 opens. That is, in the state in which the pump line 170 is interrupted, operation by the operation devices 44 to 49 is disabled and operation of swing, excavation, and so forth is prohibited.

The operation devices 44 to 49 each include a pair of pressure reducing valves of a hydraulic pilot system. These operation devices 44 to 49 use the delivery pressure of the pilot pump 19 as the source pressure to generate a pilot pressure (often referred to as operation pressure) according to the operation amount (for example, lever stroke) and the operation direction of the operation levers 22 and 23 each operated by an operator. The pilot pressure thus generated is supplied to hydraulic drive parts 150*a* to 155*b* of corresponding flow control valves 15*a* to 15*f* in a control valve unit 20 through pilot lines 144*a* to 149*b* and is used as a control signal to drive these flow control valves 15*a* to 15*f*.

A hydraulic fluid delivered from the main pump 2 is supplied to the boom cylinder 5, the arm cylinder 6, the bucket cylinder 7, the swing hydraulic motor 4, the travelling right hydraulic motor 3*a*, and the travelling left hydraulic motor 3*b* through the flow control valves 15*a* to 15*f*. The boom cylinder 5, the arm cylinder 6, and the bucket cylinder 7 extend and contract by the supplied hydraulic fluid. Due to this, the boom 8, the arm 9, and the bucket 10 are each pivoted and the position of the bucket 10 and the posture of the work device 1A are changed. The swing hydraulic motor 4 is rotated by the supplied hydraulic fluid and thereby the upper swing structure 12 is swung relative to the lower track structure 11. The travelling right hydraulic motor 3*a* and the travelling left hydraulic motor 3*b* rotate by the supplied hydraulic fluid and thereby the lower track structure 11 travels.

Figure 4:
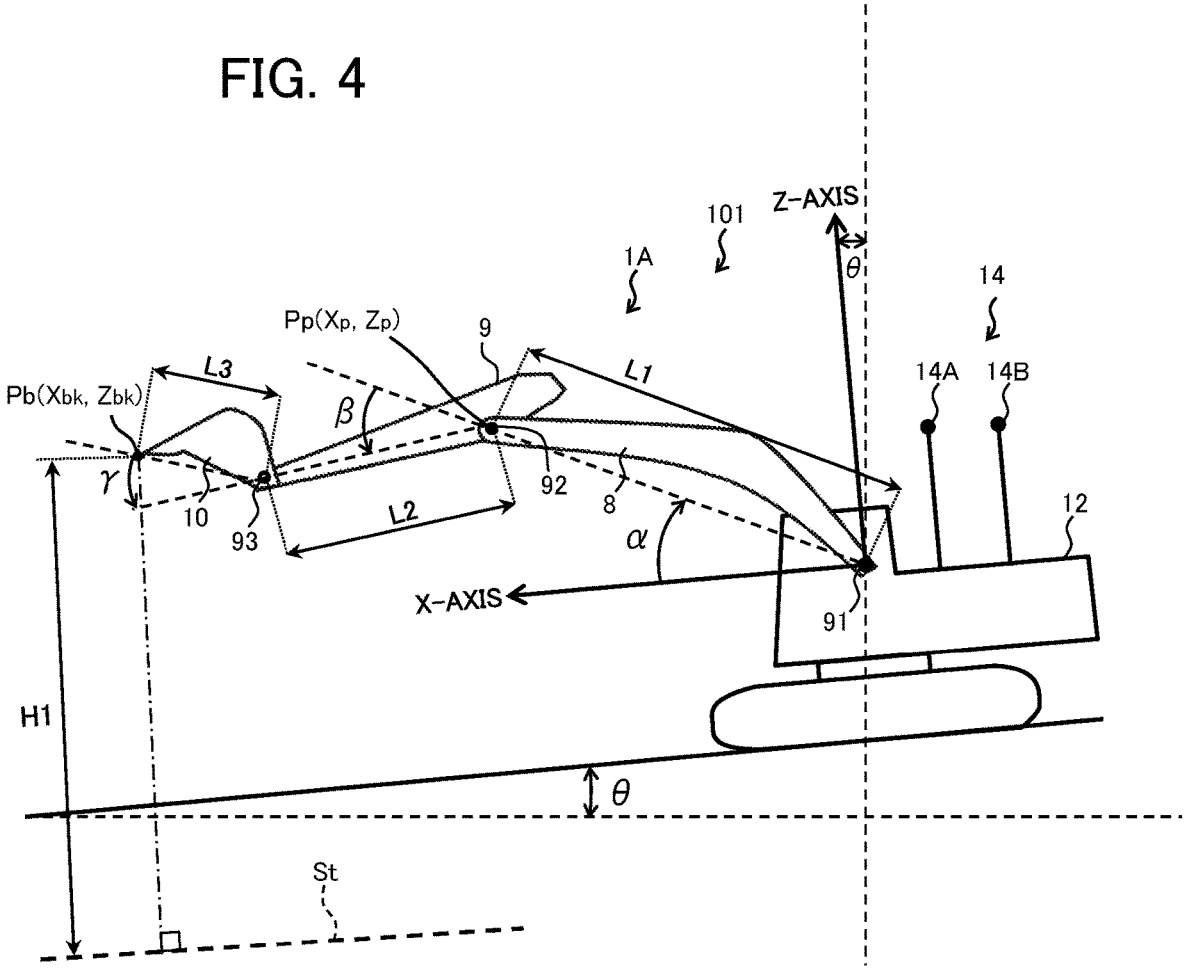
FIG. 4 is a diagram illustrating a coordinate system in the hydraulic excavator of FIG. 1.

The posture of the work device 1A can be defined based on an excavator-based coordinate system of FIG. 4. FIG. 4 is a diagram illustrating a coordinate system in the hydraulic excavator of FIG. 1. The excavator-based coordinate system of FIG. 4 is a coordinate system set with respect to the upper swing structure 12. The center axis of the boom pin 91 is defined as the origin, and a Z-axis is set in the vertical direction in the upper swing structure 12 and an X-axis is set in the horizontal direction. The inclination angle of the boom 8 with respect to the X-axis is defined as the boom angle α. The inclination angle of the arm 9 with respect to the boom 8 is defined as the arm angle β. The inclination angle of the bucket 10 with respect to the arm 9 is defined as the bucket angle γ. The inclination angle of the machine body 1B (upper swing structure 12) with respect to the horizontal plane (reference plane), i.e. the angle formed by the horizontal plane (reference plane) and the X-axis, is defined as the machine body inclination angle θ. The boom angle α is sensed by the boom angle sensor 30. The arm angle β is sensed by the arm angle sensor 31. The bucket angle γ is sensed by the bucket angle sensor 32. The machine body inclination angle θ is sensed by the machine body inclination angle sensor 33. The boom angle α becomes the smallest when the boom 8 is raised to the maximum (highest) (when the boom cylinder 5 is at the stroke end in the raising direction, i.e. when the boom cylinder length is the longest), and becomes the largest when the boom 8 is lowered to the minimum (lowest) (when the boom cylinder 5 is at the stroke end in the lowering direction, i.e. when the boom cylinder length is the shortest). The arm angle β becomes the smallest when the arm cylinder length is the shortest, and becomes the largest when the arm cylinder length is the longest. The bucket angle γ becomes the smallest when the bucket cylinder length is the shortest (at the time of FIG. 4), and becomes the largest when the bucket cylinder length is the longest.

The length from the center position of the boom pin 91, which joins the upper swing structure 12 and the boom 8, to the center position of the arm pin 92, which joins the boom 8 and the arm 9, is defined as L1. The length from the center position of the arm pin 92 to the center position of the bucket pin 93, which joins the arm 9 and the bucket 10, is defined as L2. The length from the center position of the bucket pin 93 to the tip part of the bucket 10 (for example, claw tip of the bucket 10) is defined as L3. In this case, the position of the tip part of the bucket 10 in the excavator-based coordinates (hereinafter, represented as tip position Pb) can be represented by the following expressions (1) and (2), with Xbk being the X-direction position and Zbk being the Z-direction position.

$$Xbk=L1\cos(\alpha)+L2\cos(\alpha+\beta)+L3\cos(\alpha+\beta+\gamma) \quad \text{expression (1)}$$

$$Zbk=L1\sin(\alpha)+L2\sin(\alpha+\beta)+L3\sin(\alpha+\beta+\gamma) \quad \text{expression (2)}$$

Similarly, a center position Pp of the arm pin 92 in the excavator-based coordinates can be represented by the following expressions (3) and (4), with Xp being the X-direction position and Zp being the Z-direction position.

$$Xp=L1\cos(\alpha) \quad \text{expression (3)}$$

$$Zp=L1\sin(\alpha) \quad \text{expression (4)}$$

Furthermore, as illustrated in FIG. 4, the hydraulic excavator 101 includes a pair of GNSS (Global Navigation Satellite System) antennas 14 (14A and 14B) on the upper swing structure 12. On the basis of information from the GNSS antennas 14, the position of the machine body 1B of the hydraulic excavator 101 and the position of the bucket 10 in the global coordinate system can be computed. That is, the GNSS antennas 14 function as a position sensor that senses the position of the machine body 1B.

Figure 5:
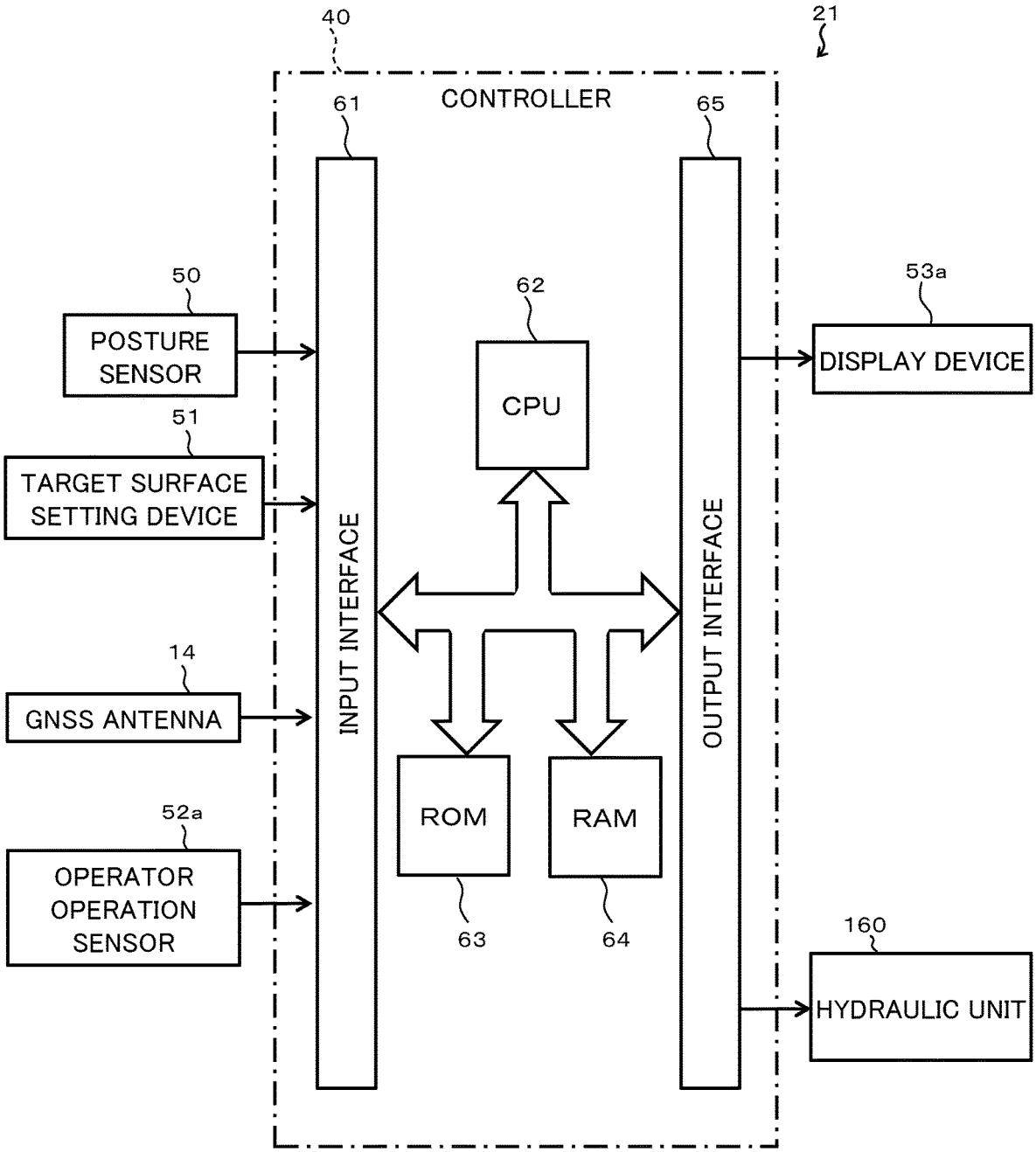
FIG. 5 is a diagram illustrating the configuration of a control system of the hydraulic excavator.

A control system 21 that carries out machine guidance (Machine Guidance: MG) and machine control (Machine Control: MC) will be described with reference to FIG. 5. FIG. 5 is a diagram illustrating the configuration of the control system 21 of the hydraulic excavator 101. As illustrated in FIG. 5, the control system 21 has a controller 40, a posture sensor 50, a target surface setting device 51, the GNSS antennas 14, and an operator operation sensor 52*a* that are connected to the controller 40 and output a signal to the controller 40, and a display device 53*a* and the hydraulic unit 160 that are connected to the controller 40 and are controlled based on a signal from the controller 40.

In this control system 21, the MC that causes the work device 1A to operate according to a condition defined in advance when at least one of the operation devices 44, 45, and 46 is operated is carried out. Control of the hydraulic actuator (5, 6, 7) in the MC is carried out by forcibly outputting a control signal (for example, to extend the boom cylinder 5 to forcibly make boom raising action) to the relevant flow control valve 15*a*, 15*b*, or 15*c*. As the MC carried out in this control system 21, "ground leveling control (area limiting control)" carried out when arm operation is carried out by the operation device 45 and "stop control" carried out when boom lowering operation is carried out without carrying out arm operation are included.

The ground leveling control (area limiting control) is the MC to control at least one of the hydraulic actuators 5, 6, and 7 in such a manner that the work device 1A is located on a predetermined target surface St (see FIG. 4 and FIG. 9) or on the upper side thereof. In the ground leveling, operation of the work device 1A is controlled in such a manner that the tip part of the bucket 10 moves along the target surface St by arm operation. Specifically, the controller 40, when the arm operation is being carried out, makes a command of fine movement of boom raising or boom lowering in such a manner that the velocity vector of the tip part of the bucket 10 (tip part of the work device 1A) in the direction perpendicular to the target surface St becomes zero. The ground leveling control (area limiting control) is carried out when a ground leveling control mode is set by a control mode changeover switch or the like that is not illustrated in the diagram and a distance H1 between the bucket 10 and the target surface St has become shorter than a predetermined distance defined in advance.

The stop control is the MC to stop boom lowering action to keep the tip part of the bucket 10 from entering the lower side relative to the target surface St. In the stop control, the controller 40 gradually decelerates boom lowering action as the tip part of the bucket 10 approaches the target surface St in boom lowering operation.

In the present embodiment, a control point of the work device 1A at the time of the MC is set to the claw tip of the bucket 10 of the hydraulic excavator 101. However, the control point can be changed also to a point other than the claw tip of the bucket 10 as long as it is a point on the tip part of the work device 1A. For example, the bottom surface of the bucket 10 or the outermost part of the bucket link 13 may be set as the control point. Furthermore, a configuration in which the point on the bucket 10 closest to the target surface St is set as the control point as appropriate may be employed. In the MC, there are "automatic control" in which operation of the work device 1A is controlled by the controller 40 at the time of non-operation of the operation devices 44, 45, and 46 and "semiautomatic control" in which operation of the work device 1A is controlled by the controller only at the time of operation of the operation device 44, 45, or 46. The MC is referred to also as "intervention control" because control by the controller 40 intervenes in operator operation.

Figure 6:
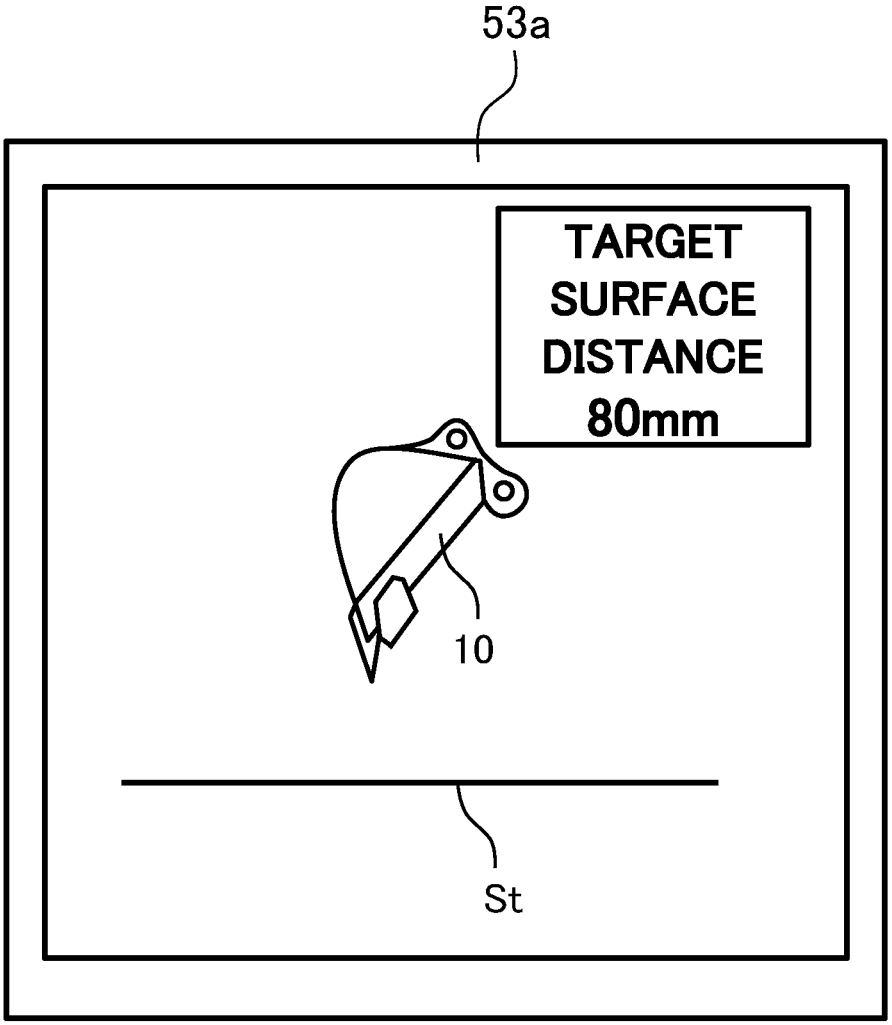
FIG. 6 is a diagram of one example of a display screen of a display device.

Furthermore, as the MG of the work device 1A in this control system 21, for example, as illustrated in FIG. 6, processing of displaying the positional relation between the target surface St and the work device 1A (for example, bucket 10) on the display device 53*a* is executed.

As illustrated in FIG. 5, the control system 21 includes the posture sensor 50, the target surface setting device 51, the GNSS antennas 14, the operator operation sensor 52*a*, the display device 53*a*, the hydraulic unit 160 having plural solenoid proportional valves (solenoid pressure reducing valves), and the controller 40 responsible for the MG and the MC.

The posture sensor 50 has the boom angle sensor 30 attached to the boom 8, the arm angle sensor 31 attached to the arm 9, the bucket angle sensor 32 attached to the bucket 10, and the machine body inclination angle sensor 33 attached to the machine body 1B. These angle sensors (30, 31, 32, and 33) acquire information relating to the posture of the work device 1A and output a signal according to the information. That is, the angle sensors (30, 31, 32, and 33) function as a posture sensor that senses the posture of the work device 1A. For example, as the angle sensors 30, 31, and 32, potentiometers that acquire the boom angle, the arm angle, and the bucket angle as the information relating to the posture and output a signal (voltage) according to the acquired angle can be employed. Furthermore, as the machine body inclination angle sensor 33, an IMU (Inertial Measurement Unit: inertial measurement device) that acquires the angular velocities and the accelerations of orthogonal three axes as the information relating to the posture and calculates the inclination angle θ on the basis of this information to output a signal that represents the inclination angle θ to the controller 40 can be employed. The controller 40 may carry out the calculation of the inclination angle θ on the basis of an output signal of the IMU.

The target surface setting device 51 is a device that can input, to the controller 40, information relating to the target surface St (position information of one target surface or plural target surfaces, information on the inclination angle of the target surface with respect to a reference plane (horizontal plane), and so forth). The target surface setting device 51 is connected to an external terminal (not illustrated) in which three-dimensional data of target surfaces defined on the global coordinate system (absolute coordinate system) is stored. The input of the target surface through the target surface setting device 51 may be manually carried out by the operator.

The operator operation sensor 52*a* has pressure sensors 70*a*, 70*b*, 71*a*, 71*b*, 72*a*, and 72*b* (see FIG. 3) that acquire the operation pressure (first control signal) generated in the pilot lines 144, 145, and 146 through operation of the operation levers 22*a* and 22*b* (operation devices 44, 45, and 46) by the operator. That is, the operator operation sensor 52*a* senses operation to the hydraulic cylinders 5, 6, and 7 relating to the work device 1A.

As illustrated in FIG. 3, the pressure sensors 70*a* and 70*b* are operation sensors that are disposed on the pilot lines 144*a* and 144*b* of the operation device 44 for the boom 8 and sense the pilot pressure (first control signal) as the operation amount of the operation lever 22*a*. The pressure sensors 71*a* and 71*b* are operation sensors that are disposed on the pilot lines 145*a* and 145*b* for the arm 9 and sense the pilot pressure (first control signal) as the operation amount of the operation lever 22*b*. The pressure sensors 72*a* and 72*b* are operation sensors that are disposed on the pilot lines 146*a* and 146*b* for the bucket 10 and sense the pilot pressure (first control signal) as the operation amount of the operation lever 22*a*.

FIG. 6 is a diagram of one example of a display screen of the display device 53*a*. As illustrated in FIG. 6, the display device 53*a* displays various display images on the display screen on the basis of a display control signal from the controller 40. The display device 53*a* is a liquid crystal monitor of a touch panel system, for example, and is set in the cab 16. The controller 40 can cause the display screen of the display device 53*a* to display a display image that represents the positional relation between the target surface St and the work device 1A (for example, bucket 10). In the example illustrated in the diagram, images that represent the target surface St and the bucket 10 are displayed and the distance from the target surface St to the tip part of the bucket 10 is displayed as the target surface distance.

As illustrated in FIG. 3, the hydraulic unit 160 for work device control includes a solenoid proportional valve 54*a* that has the primary port side connected to the pilot pump 19 through the pump line 170 and reduces the pilot pressure from the pilot pump 19 to output the resulting pressure, a shuttle valve 82*a* that is connected to the pilot line 144*a* of the operation device 44 for the boom 8 and the secondary port side of the solenoid proportional valve 54*a* and selects the higher pressure side of the pilot pressure in the pilot line 144*a* and a control pressure (second control signal) output from the solenoid proportional valve 54*a* to introduce the higher pressure side to the hydraulic drive part 150*a* of the flow control valve 15*a*, and a solenoid proportional valve 54*b* that is disposed on the pilot line 144*b* of the operation device 44 for the boom 8 and reduces the pilot pressure (first control signal) in the pilot line 144*b* on the basis of a control signal from the controller 40 to output the resulting pressure to the hydraulic drive part 150*b* of the flow control valve 15*a*.

Furthermore, the hydraulic unit 160 includes a solenoid proportional valve 55*a* that is disposed on the pilot line 145*a* and reduces the pilot pressure (first control signal) in the pilot line 145*a* on the basis of the control signal from the controller 40 to output the resulting pressure to the hydraulic drive part 151*a* of the flow control valve 15*b* and a solenoid proportional valve 55*b* that is disposed on the pilot line 145*b* and reduces the pilot pressure (first control signal) in the pilot line 145*b* on the basis of the control signal from the controller 40 to output the resulting pressure to the hydraulic drive part 151*b* of the flow control valve 15*b*.

Moreover, the hydraulic unit 160 includes solenoid proportional valves 56*a* and 56*b* that are disposed on the pilot lines 146*a* and 146*b* and reduce the pilot pressure (first control signal) in the pilot lines 146*a* and 146*b* on the basis of the control signal from the controller 40 to output the resulting pressure, solenoid proportional valves 56*c* and 56*d* that have the primary port side connected to the pilot pump 19 through the pump line 170 and reduce the pilot pressure from the pilot pump 19 to output the resulting pressure, and shuttle valves 83*a* and 83*b* that are connected to the pilot lines 146*a* and 146*b* of the operation device 46 for the bucket 10 and the secondary port side of the solenoid proportional valves 56*c* and 56*d* and select the higher pressure side of the pilot pressure in the pilot line 146*a* or 146*b* and the control pressure output from the solenoid proportional valve 56*c* or 56*d* to introduce the higher pressure side to the hydraulic drive part 152*a* or 152*b* of the flow control valve 15*c*.

In the solenoid proportional valves 54*b*, 55*a*, 55*b*, 56*a*, and 56*b*, the degree of opening is the maximum at the time of non-energization and the degree of opening becomes lower as a current that is the control signal from the controller 40 is increased. On the other hand, in the solenoid proportional valves 54*a*, 56*c*, and 56*d*, the degree of opening is the minimum (for example, 0 (zero)) at the time of non-energization and the degree of opening becomes higher as a current that is the control signal from the controller 40 is increased. As above, the degree of opening of the solenoid proportional valves 54, 55, and 56 becomes what depends on the control signal from the controller 40.

In the hydraulic unit 160 configured as above, when the control signal is output from the controller 40 and the solenoid proportional valves 54*a*, 56*c*, and 56*d* are driven, the pilot pressure (second control signal) can be generated even in the case in which operator operation to the corresponding operation device 44 or 46 is not made. Therefore, boom raising action, bucket crowding action, and bucket dumping action can be forcibly carried out. Furthermore, similarly to this, when the solenoid proportional valves 54*b*, 55*a*, 55*b*, 56*a*, and 56*b* are driven by the controller 40, the pilot pressure (second control signal) obtained by reducing the pilot pressure (first control signal) generated through operator operation to the operation device 44, 45, or 46 can be generated, and the velocity of boom lowering action, arm crowding/dumping action, and bucket crowding/dumping action can be forcibly reduced from the value of the operator operation.

In the present specification, in the control signals to the flow control valves 15*a* to 15*c*, the pilot pressure generated by operation of the operation device 44, 45, or 46 is referred to as the "first control signal." Furthermore, in the control signals to the flow control valves 15*a* to 15*c*, the pilot pressure generated through driving the solenoid proportional valve 54*b*, 55*a*, 55*b*, 56*a*, or 56*b* by the controller 40 and correcting (reducing) the first control signal and the pilot pressure newly generated separately from the first control signal through driving the solenoid proportional valve 54*a*, 56*c*, or 56*d* by the controller 40 are referred to as the "second control signal."

The second control signal is generated when the velocity of the control point of the work device 1A (in the present embodiment, tip part of the bucket 10) generated by the first control signal goes against a predetermined condition and is generated as a control signal that generates the velocity of the control point of the work device 1A that does not go against this predetermined condition. When the first control signal is generated for one hydraulic drive part in the same flow control valve 15*a* to 15*c* and the second control signal is generated for the other hydraulic drive part, the second control signal is allowed to preferentially act on the hydraulic drive part. Thus, the first control signal is interrupted by the solenoid proportional valve and the second control signal is input to the other hydraulic drive part. Therefore, in the flow control valves 15*a* to 15*c*, one for which the second control signal is calculated is controlled based on the second control signal, and one for which the second control signal is not calculated is controlled based on the first control signal, and one for which neither the first nor second control signal is generated is not controlled (driven). When the first control signal and the second control signal are defined as described above, it can also be said that the MC is control of the flow control valves 15*a* to 15*c* based on the second control signal.

As illustrated in FIG. 5, the controller 40 has an input interface 61, a central processing unit (CPU) 62 that is a processor, a read-only memory (ROM) 63 that is a storing device, a random access memory (RAM) 64 that is a storing device, and an output interface 65. To the input interface 61, signals from the angle sensors 30 to 33, which are the posture sensor 50, a signal from the target surface setting device 51, which is a device for setting the target surface St, a signal from the GNSS antennas 14, and signals from the pressure sensors 70*a*, 70*b*, 71*a*, 71*b*, 72*a*, and 72*b*, which are the operator operation sensor 52*a*, are input to be so converted as to allow calculation by the CPU 62. The ROM 63 is a storage medium in which a control program for executing the MC and the MG including processing to be described later and various kinds of information and so forth necessary for execution of the relevant processing are stored. The CPU 62 executes predetermined calculation processing for signals taken in from the input interface 61 and the ROM 63 and the RAM 64, according to the control program stored in the ROM 63. The output interface 95 generates a signal for output according to a calculation result in the CPU 62 and outputs the signal to the hydraulic unit 160 and the display device 53*a*. When the signal (excitation current) from the controller 40 is input to the solenoid proportional valve of the hydraulic unit 160, the solenoid proportional valve is actuated based on the signal. When the signal (display control signal) from the controller 40 is input to the display device 53*a*, the display device 53*a* displays a display image on the display screen on the basis of the signal.

The controller 40 illustrated in FIG. 5 includes semiconductor memories, the ROM 63 and the RAM 63, as a storing device. However, they can be replaced by another device as long as it is a storing device. For example, the controller 40 may include a magnetic storing device such as a hard disk drive.

In the controller 40, the ground leveling control mode is set by the control mode changeover switch or the like that is not illustrated in the diagram as described above. When the distance H1 between the bucket 10 and the target surface St has become shorter than a predetermined distance defined in advance, the ground leveling control (area limiting control) is carried out.

When the ground leveling control mode is set, the controller 40 sets the target surface St and calculates the bucket-to-target surface distance H1 that is the distance from the bucket 10 to the target surface St on the basis of signals from the GNSS antennas 14 and the angle sensors 30 to 33. Furthermore, when operation of the arm 9 is carried out by the operation device 45 and the bucket-to-target surface distance H1 has become shorter than a predetermined distance Ya, the controller 40 controls the boom 8 and carries out deceleration control to decelerate the arm 9 to keep the bucket 10 from excavating the ground beyond the target surface St.

Here, if the deceleration control to decelerate the arm 9 is carried out across the board when the bucket-to-target surface distance H1 is shorter than the predetermined distance Ya, the deceleration control is carried out also in the case in which there is no need to decelerate the arm 9, for example, the case in which entry of the bucket 10 into the target surface (that is, excavation of the ground beyond the target surface St by the bucket 10) is not envisaged from the posture of the work device 1A and the positional relation between the work device 1A and the target surface St. Thus, there is a fear of the lowering of the work efficiency.

Thus, the controller 40 according to the present embodiment is configured to determine whether or not there is a possibility that the bucket 10 enters the target surface St when operation of the arm 9 is carried out based on the set target surface St and signals from the GNSS antennas 14 and the angle sensors 30 to 33 and not to carry out the deceleration control of the arm 9 even when the bucket-to-target surface distance H1 is shorter than the predetermined distance Ya in the case in which it is determined that there is no possibility that the bucket 10 enters the target surface St. Functions of the controller 40 will be described in detail below.

Figure 7:
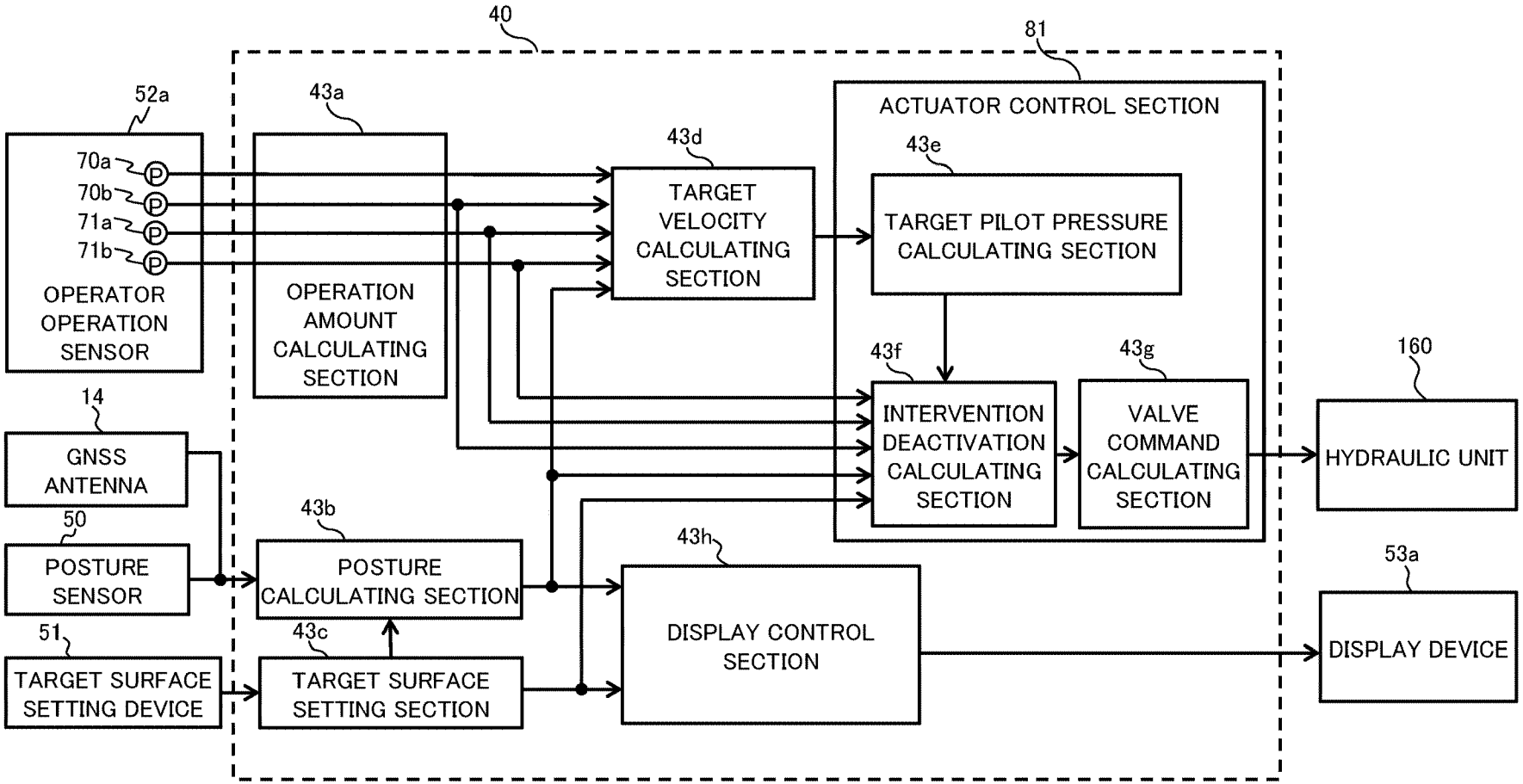
FIG. 7 is a functional block diagram of the controller.

FIG. 7 is a functional block diagram of the controller 40. The controller 40 functions as an operation amount calculating section 43*a*, a posture calculating section 43*b*, a target surface setting section 43*c*, a target velocity calculating section 43*d*, a target pilot pressure calculating section 43*e*, an intervention deactivation calculating section 43*f*, a valve command calculating section 43*g*, and a display control section 43*h* by executing a program stored in the storing device. The target pilot pressure calculating section 43*e*, the intervention deactivation calculating section 43*f*, and the valve command calculating section 43*g* function as an actuator control section 81 that controls the hydraulic cylinders (5, 6, and 7) that are actuators by controlling the solenoid proportional valves of the hydraulic unit 160.

The operation amount calculating section 43*a* computes the operation amount of the operation devices 44, 45, and 46 (operation levers 22*a* and 22*b*) on the basis of signals from the operator operation sensor 52*a* (i.e. signals that represent sensed values of the pressure sensors 70, 71, and 72). The operation amount of boom raising operation that is operation for causing the boom 8 to make raising action is computed from the sensed value of the pressure sensor 70*a*. The operation amount of boom lowering operation that is operation for causing the boom 8 to make lowering action is computed from the sensed value of the pressure sensor 70*b*. The operation amount of arm crowding (arm pulling) operation that is operation for causing the arm 9 to make crowding action is computed from the sensed value of the pressure sensor 71*a*. The operation amount of arm dumping (arm pushing) operation that is operation for causing the arm 9 to make dumping action is computed from the sensed value of the pressure sensor 71*b*. The operation amounts thus converted from the sensed values of the pressure sensors 70, 71, and 72 are output to the target velocity calculating section 43*d*. Furthermore, although diagrammatic representation in FIG. 7 is omitted, the operation amount calculating section 43*a* calculates also the operation amount of bucket crowding/dumping from the sensed value of the pressure sensor 72 and the calculation result is output to the target velocity calculating section 43*d*.

The computation method of the operation amount is not limited to the case in which the operation amount is computed based on the sensing result of the pressure sensor 70, 71, or 72. For example, a position sensor (for example, rotary encoder) that senses rotational displacement of the operation lever of the respective operation devices 44, 45, and 46 may be disposed as an operation sensor and the operation amount of the relevant operation lever may be computed based on the sensing result of this position sensor.

The target surface setting section 43*c* sets the target surface St on the basis of information from the target surface setting device 51. Specifically, the target surface setting section 43*c* calculates position information of the target surface St on the basis of the information from the target surface setting device 51 and stores it in the RAM 64. In the present embodiment, as illustrated in FIG. 8, a sectional shape obtained by cutting a three-dimensional target surface by a plane along which the work device 1A moves (operation plane of the work device) is used as the target surface St (two-dimensional target surface).

As illustrated in FIG. 7, the posture calculating section 43*b* calculates the posture of the work device 1A in a local coordinate system (excavator-based coordinates), the tip position Pb (Xbk, Zbk) of the bucket 10, and the center position Pp (Xp, Zp) of the arm pin 92 on the basis of a signal (information relating to the angle) from the posture sensor 50 and geometric information (L1, L2, L3) of the work device 1A stored in the storing device. As already described, the tip position Pb (Xbk, Zbk) of the bucket 10 can be calculated by expression (1) and expression (2). Furthermore, the center position Pp (Xp, Zp) of the arm pin 92 can be calculated by expression (3) and expression (4). When the posture of the work device 1A and the position of the tip of the bucket 10 in the global coordinate system are necessary, the posture calculating section 43*b* computes the position and the posture in the global coordinate system regarding the upper swing structure 12 that configures the machine body 1B from a signal of the GNSS antennas 14 and converts local coordinates to global coordinates.

Moreover, the posture calculating section 43*b* calculates various kinds of data (H1, H2, Dpb, φ) that represent the positional relation between the target surface St and the work device 1A on the basis of the target surface St set by the target surface setting section 43*c*, a signal (information relating to the position of the machine body 1B) from the GNSS antennas 14, a signal (information relating to the angle) from the posture sensor 50, and the geometric information (L1, L2, L3) of the work device 1A stored in the storing device. These calculations will be described in detail below with reference to FIG. 8. FIG. 8 is a diagram illustrating the various kinds of data (H1, H2, Dpb, φ) that represent the positional relation between the work device 1A and the target surface St.

Figure 8:
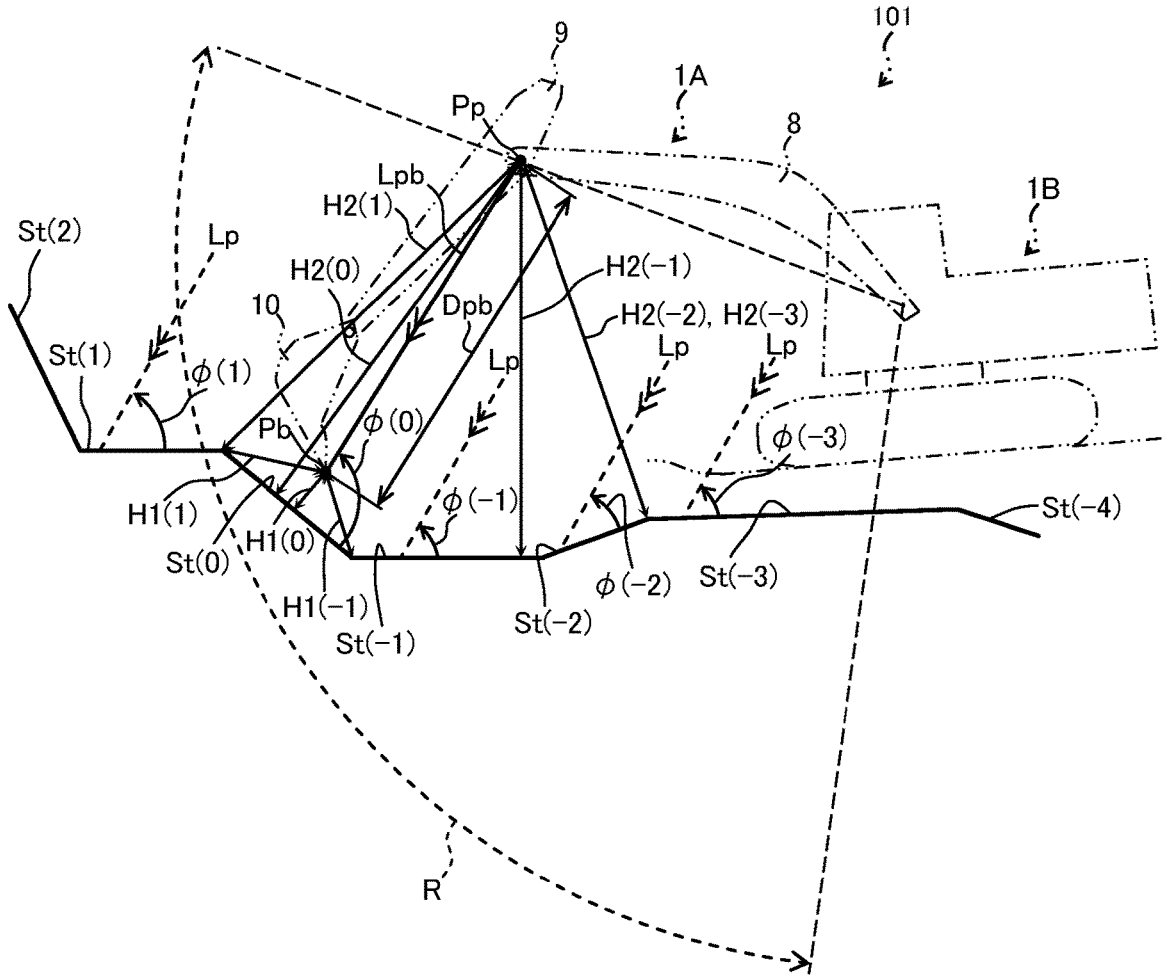
FIG. 8 is a diagram illustrating various kinds of data that represent the positional relation between a work device and a target surface.

As illustrated in FIG. 8, the posture calculating section 43*b* calculates the shortest distance from the tip position Pb (Xbk, Zbk) of the bucket 10 to the target surface St as the bucket-to-target surface distance H1 on the basis of the set target surface St, the signals from the GNSS antennas 14 and the posture sensor 50, and the geometric information of the work device 1A stored in the storing device. In the present embodiment, plural target surfaces St are continuously set. The posture calculating section 43*b* calculates the bucket-to-target surface distance H1 regarding all target surfaces St and, from this calculation result, sets the target surface with the shortest distance from the tip part of the bucket 10, i.e. the target surface closest to the tip part of the bucket 10, as the closest target surface. The posture calculating section 43*b* may set the closest target surface through calculating the maximum work range of the work device 1A and calculating the bucket-to-target surface distance H1 only regarding the target surfaces that exist in the maximum work range in the set plural target surfaces St. The posture calculating section 43*b*, when a perpendicular line can be drawn to the target surface St from the tip position Pb of the bucket 10, sets the length of the perpendicular line as the bucket-to-target surface distance H1. The posture calculating section 43*b*, when it is impossible to draw a perpendicular line to the target surface St from the tip position Pb of the bucket 10, sets the shorter length in the lengths of line segments, which link the tip position Pb of the bucket 10 with both end positions of the target surface St, as the bucket-to-target surface distance H1.

In the following, with use of the character n for discrimination of the respective target surfaces, plural target surfaces St(n) will be described. The above-described closest target surface St is represented as St(0) (i.e. St(n), n=0). Furthermore, the target surface that exists on the far side relative to the closest target surface St(0) as viewed from the machine body 1B is represented also as the far-side target surface St(n) and n is a positive integer that is equal to or larger than 1 and sequentially increments one by one as the target surface becomes farther from that closest to the closest target surface St(0). That is, the target surface on the far side closest to the closest target surface St(0) is the far-side target surface St(1) and the next closest target surface on the far side is the far-side target surface St(2). On the other hand, the target surface that exists on the near side relative to the closest target surface St(0) as viewed from the machine body 1B is represented also as the near-side target surface St(n) and n is a negative integer that is equal to or smaller than −1 and sequentially decrements one by one as the target surface becomes farther from that closest to the closest target surface St(0). That is, the target surface on the near side closest to the closest target surface St(0) is the near-side target surface St(−1) and the next closest target surface on the near side is the near-side target surface St(−2).

In the example illustrated in FIG. 8, the shortest distance H1(0) from the tip position Pb of the bucket 10 to the closest target surface St(0) is equivalent to the length of a perpendicular line drawn to the closest target surface St(0) from the tip position Pb of the bucket 10. The shortest distance H1(1) from the tip position Pb of the bucket 10 to the far-side target surface St(1) is equivalent to the length of a line segment that links the tip position Pb of the bucket 10 with the near-side end point of the far-side target surface St(1). The shortest distance H1(−1) from the tip position Pb of the bucket 10 to the near-side target surface St(−1) is equivalent to the length of a line segment that links the tip position Pb of the bucket 10 with the far-side end point of the near-side target surface St(−1).

The posture calculating section 43*b* calculates a pin-to-target surface distance H2(*n*) that is the shortest distance from the center position Pp (Xp, Zp) of the arm pin 92 to the target surface St(n) on the basis of the set target surface St, the signals from the GNSS antennas 14 and the posture sensor 50, and the geometric information of the work device 1A stored in the storing device. The posture calculating section 43*b*, when a perpendicular line can be drawn to the target surface St(n) from the center position Pp of the arm pin 92, calculates the length of the perpendicular line as the pin-to-target surface distance H2(*n*). The posture calculating section 43*b*, when it is impossible to draw a perpendicular line to the target surface St(n) from the center position Pp of the arm pin 92, calculates the shorter length in the lengths of line segments, which link the center position Pp of the arm pin 92 with both end positions of the target surface St(n), as the pin-to-target surface distance H2(*n*).

In the example illustrated in FIG. 8, the shortest distance H2(0) from the center position Pp of the arm pin 92 to the closest target surface St(0) is equivalent to the length of a perpendicular line drawn to the closest target surface St(0) from the center position Pp of the arm pin 92. The shortest distance H2(1) from the center position Pp of the arm pin 92 to the far-side target surface St(1) is equivalent to the length of a line segment that links the center position Pp of the arm pin 92 with the near-side end point of the far-side target surface St(1). The shortest distance H2(−1) from the center position Pp of the arm pin 92 to the near-side target surface St(−1) is equivalent to the length of a perpendicular line drawn to the near-side target surface St(−1) from the center position Pp of the arm pin 92.

The posture calculating section 43*b* calculates the shortest distance (linear distance) from the center position Pp (Xp, Zp) of the arm pin 92 to the tip position Pb (Xbk, Zbk) of the bucket 10 as the pin-to-bucket distance Dpb on the basis of the signal from the posture sensor 50 and the geometric information of the work device 1A stored in the storing device. The pin-to-bucket distance Dpb is equivalent to the length of a line segment Lpb that links the center position Pp with the tip position Pb.

The posture calculating section 43*b* calculates the line segment Lpb, which links the center position Pp (Xp, Zp) of the arm pin 92 with the tip position Pb (Xbk, Zbk) of the bucket 10, and an angle φ(n) formed by the line segment Lpb and the target surface St(n) on the basis of the set target surface St, the signals from the GNSS antennas 14 and the posture sensor 50, and the geometric information of the work device 1A stored in the storing device. Hereinafter, the angle formed by the line segment Lpb and the target surface St(n) is represented also as the angle φ(n) simply. In the present embodiment, the angle φ(n) refers to the angle formed by a straight line Lp parallel to the line segment Lpb and the target surface St(n) on the side of the machine body 1B relative to the straight line Lp when the straight line Lp is positioned on the target surface St(n) as illustrated in the diagram.

As illustrated in FIG. 7, the display control section 43*h* executes processing of displaying, on the display device 53*a*, a display image (see FIG. 6) that represents the positional relation between the target surface St set in the target surface setting section 43*c* and the tip part of the bucket 10 calculated in the posture calculating section 43*b*.

Figure 9:
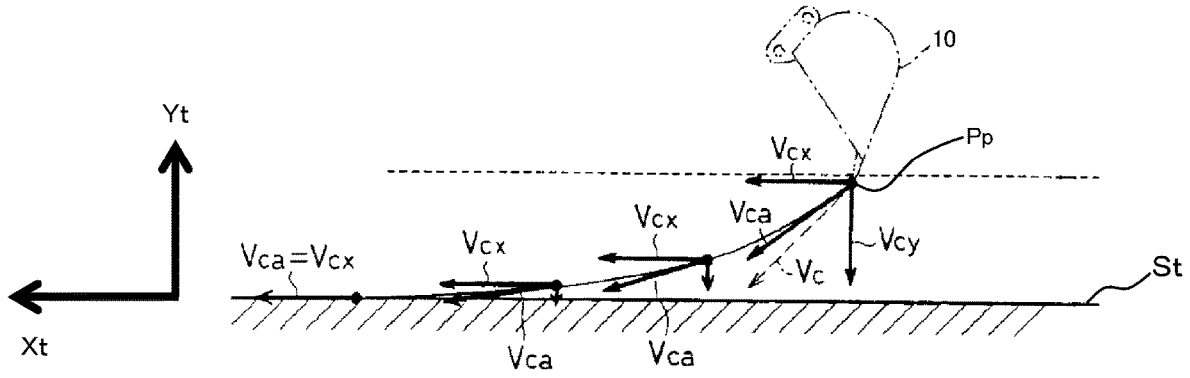
FIG. 9 is a diagram illustrating one example of the locus of the tip of a bucket when the tip of the bucket is controlled according to a target velocity vector Vca after correction.

The target velocity calculating section 43*d* calculates the target velocity of the respective hydraulic cylinders 5, 6, and 7 on the basis of the calculation result in the posture calculating section 43*b* and the calculation result in the operation amount calculating section 43*a*. The target velocity calculating section 43*d* calculates the target velocity of the respective hydraulic cylinders 5, 6, and 7 in such a manner that the lower side of the target surface St is kept from being excavated by the work device 1A in the ground leveling control (area limiting control). Detailed description will be made below with reference to FIG. 9. FIG. 9 is a diagram illustrating one example of the locus of the tip of the bucket 10 when the tip of the bucket 10 is controlled according to a target velocity vector Vca after correction. In the description here, an Xt-axis and a Yt-axis are set as illustrated in FIG. 9. The Xt-axis is an axis parallel to the target surface St and the Yt-axis is an axis orthogonal to the target surface St.

The target velocity calculating section 43*d* calculates the target velocity (primary target velocity) of the respective hydraulic cylinders 5, 6, and 7 on the basis of the operation amount of the operation devices 44, 45, and 46 calculated by the operation amount calculating section 43*a*. Next, the target velocity calculating section 43*d* calculates a target velocity vector Vc of the tip part of the bucket 10 illustrated in FIG. 9 on the basis of the target velocity (primary target velocity) of the respective hydraulic cylinders 5, 6, and 7, the tip position Pp of the bucket 10 calculated in the posture calculating section 43*b*, and the dimensions (L1, L2, L3, and so forth) of the respective parts of the work device 1A stored in the ROM 63. Control to convert the velocity vector of the tip part of the bucket 10 to Vca (direction conversion control) is carried out by calculating secondary target velocity through correcting the primary target velocity of the necessary hydraulic cylinder in the hydraulic cylinders 5, 6, and 7 in such a manner that a component Vcy perpendicular to the target surface St (velocity component in the Yt-axis direction) in the target velocity vector Vc of the tip part of the bucket 10 comes closer to 0 (zero) as the distance (target surface distance) H1 between the tip part of the bucket 10 and the closest target surface St(0) comes closer to 0 (zero). The target velocity vector Vca when the target surface distance H1 is 0 (zero) is only a component Vcx parallel to the target surface St (velocity component in the Xt-axis direction). Due to this, the tip part (control point) of the bucket 10 is kept to be located on the target surface St or on the upper side thereof.

In the direction conversion control, for example, as illustrated in FIG. 9, when operation of arm crowding is solely carried out by the operation device 45, the velocity vector Vc is converted to Vca by extending the arm cylinder 6 and extending the boom cylinder 5. Here, when the arm cylinder 6 is driven at a velocity (for example, maximum velocity) according to the operation amount of the arm crowding (for example, maximum operation amount), the extension action of the boom cylinder 5 is late for it and there is a fear that the tip part of the bucket 10 goes beyond the target surface St and excavates the ground to the lower side of the target surface St. Thus, in the present embodiment, the target velocity calculating section 43*d* corrects the primary target velocity calculated based on the operation amount of the arm 9 by the operator and sets the secondary target velocity lower than the primary target velocity as the target velocity of the arm cylinder 6.

There is the case in which the direction conversion control is carried out based on a combination of boom raising or boom lowering and arm crowding, and there is the case in which the direction conversion control is carried out based on a combination of boom raising or boom lowering and arm dumping. In either case, when the target velocity vector Vc includes such a downward component as to get closer to the excavation target surface St (Vcy<0), the target velocity calculating section 43*d* calculates the target velocity of the boom cylinder 5 in the boom raising direction that cancels out the downward component. Conversely, when the target velocity vector Vc includes such an upward component as to get farther away from the excavation target surface St (Vcy>0), the target velocity calculating section 43*d* calculates the target velocity of the boom cylinder 5 in the boom lowering direction that cancels out the upward component.

When a mode in which the ground leveling control (area limiting control) is not carried out is set by the control mode changeover switch that is not illustrated in the diagram, the target velocity calculating section 43*d* outputs the target velocity of the respective hydraulic cylinders 5 to 7 according to the operation of the operation devices 44 to 46.

As illustrated in FIG. 7, the target pilot pressure calculating section 43*e* calculates target pilot pressures to the flow control valves 15*a*, 15*b*, and 15*c* of the respective hydraulic cylinders 5, 6, and 7 on the basis of the target velocity of the respective cylinders 5, 6, and 7 calculated in the target velocity calculating section 43*d*.

Here, the target pilot pressure for the flow control valve 15*b* that controls action of the arm cylinder 6 is equivalent to a target value of a pilot pressure (second control signal) generated by reducing a pilot pressure (first control signal) output from the operation device 45 when the operation lever 22*b* of the operation device 45 of the arm 9 is operated to the maximum, for example.

Thus, when the secondary target velocity lower than the primary target velocity calculated based on the operation amount (maximum operation amount) of the arm 9 by the operator is set by the target velocity calculating section 43*d*, the target pilot pressure calculating section 43*e* sets the target pilot pressure lower than the pilot pressure output from the operation device 45. As a result, the solenoid proportional valve 55 is operated by a control signal from the valve command calculating section 43*g* to be described later and the pilot pressure (first control signal) output from the operation device 45 is reduced by the solenoid proportional valve 55, thus the pilot pressure (second control signal) is generated. Due to this, the arm 9 makes action at velocity lower than the velocity according to the operation amount (for example, maximum operation amount) of the operator regarding the operation device 45. That is, in the controller 40 according to the present embodiment, the deceleration control to decelerate the arm 9 can be carried out with intervention in operation by the operator when a predetermined condition holds.

The intervention deactivation calculating section 43*f* decides whether or not to carry out the deceleration control of the arm 9 with intervention in operation by the operator. In other words, the intervention deactivation calculating section 43*f* decides whether or not to deactivate the deceleration control of the arm 9 carried out with intervention in operation by the operator to the operation device 45 of the arm 9. The intervention deactivation calculating section 43*f* determines whether or not a condition to deactivate intervention in operation by the operator (deceleration control of the arm 9) (hereinafter, represented as intervention deactivation condition) holds, on the basis of the calculation result in the operation amount calculating section 43*a*, the calculation result in the posture calculating section 43*b*, and the target surface St set in the target surface setting section 43*c*.

When the intervention deactivation condition does not hold, the intervention deactivation calculating section 43*f* decides not to deactivate the deceleration control of the arm 9. In this case, the intervention deactivation calculating section 43*f* outputs the target pilot pressure calculated in the target pilot pressure calculating section 43*e* (target pilot pressure to the flow control valve 15*b*) to the valve command calculating section 43*g* as it is. On the other hand, when the intervention deactivation condition holds, the intervention deactivation calculating section 43*f* corrects the target pilot pressure calculated in the target pilot pressure calculating section 43*e* (target pilot pressure to the flow control valve 15*b*) to a maximum pressure Pmax and outputs it to the valve command calculating section 43*g*.

When the maximum pressure Pmax is set as the target pilot pressure to the flow control valve 15*b* of the arm cylinder 6, the solenoid proportional valve 55 becomes the fully-opened state due to the control signal from the valve command calculating section 43*g* to be described later. That is, when the operation lever 22*b* of the operation device 45 of the arm 9 is operated to the maximum, the pilot pressure (maximum pressure Pmax) output from the operation device 45 acts on the flow control valve 15*b* as it is without being reduced. Due to this, the arm 9 makes action at the velocity according to the operation amount (for example, maximum operation amount) of the operator regarding the operation device 45.

The intervention deactivation calculating section 43*f* outputs the target pilot pressures to the flow control valves 15*a* and 15*c* calculated in the target pilot pressure calculating section 43*e* to the valve command calculating section 43*g* as they are irrespective of whether or not holding of the intervention deactivation condition is necessary.

In the present embodiment, the intervention deactivation condition holds when any of the following (condition 1) and (condition 2) is satisfied, and does not hold when neither (condition 1) nor (condition 2) is satisfied.

(Condition 1) The bucket-to-target surface distance H1 is equal to or longer than the predetermined distance Ya.

(Condition 2) There is no possibility that the bucket 10 enters the target surface St when operation of the arm 9 is carried out.

—About Condition 1—

In the ground leveling control, it is preferable that the deceleration control of the arm 9 is carried out only when the distance between the tip part of the bucket 10 and the target surface St is short and the deceleration control of the arm 9 is not carried out when the distance between the tip part of the bucket 10 and the target surface St is somewhat long. This can improve the work efficiency of the work device 1A in the ground leveling control.

In the present embodiment, the intervention deactivation calculating section 43*f* determines that the intervention deactivation condition does not hold when the bucket-to-target surface distance H1 is shorter than the predetermined distance Ya, and determines that the intervention deactivation condition holds when the bucket-to-target surface distance H1 is equal to or longer than the predetermined distance Ya. The predetermined distance Ya is a threshold for determining whether or not the tip part of the bucket 10 is located near the target surface St and is stored in the storing device of the controller 40 in advance. In the present embodiment, Ya1 is stored in the storing device as the threshold Ya used when arm crowding operation is carried out and a threshold Ya2 is stored in the storing device as the threshold Ya used when arm dumping operation is carried out. The threshold Ya1 and the threshold Ya2 may be values identical to each other or may be different values.

—About Condition 2—

In the ground leveling control, it is preferable that the deceleration control of the arm 9 is not carried out when it is determined that there is no possibility that the bucket 10 enters the target surface St due to operation of the arm 9 even when the bucket-to-target surface distance H1 is shorter than the predetermined distance Ya. This can improve the work efficiency of the work device 1A in the ground leveling control. Thus, in the present embodiment, the intervention deactivation calculating section 43*f* determines whether or not the posture of the work device 1A is such a posture that the bucket 10 enters the target surface St when operation of the arm 9 is carried out (hereinafter, represented as entry posture). When it is determined that the posture of the work device 1A is not the entry posture, the intervention deactivation calculating section 43*f* determines that there is no possibility that the bucket 10 enters the target surface St when operation of the arm 9 is carried out. When it is determined that the posture of the work device 1A is the entry posture, the intervention deactivation calculating section 43*f* determines that there is a possibility that the bucket 10 enters the target surface St when operation of the arm 9 is carried out.

—First Entry Posture Determination Processing (First Bucket Entry Determination Processing)—

In the present embodiment, the intervention deactivation calculating section 43*f* executes processing of determining whether or not the posture of the work device 1A is the entry posture (first entry posture determination processing) on the basis of the pin-to-bucket distance Dpb and the pin-to-target surface distance H2 calculated in the posture calculating section 43*b*. The first entry posture determination processing is equivalent to processing of determining whether or not there is a possibility that the bucket 10 enters the target surface St (first bucket entry determination processing) by discriminating whether or not the target surface St exists on the movement locus of the tip part of the bucket 10 when operation of the arm 9 is carried out.

In the present embodiment, for example, in the ground leveling control, when arm crowding operation is carried out, the pilot pressure (second control signal) is generated in the solenoid proportional valve 54*a* and boom raising action is carried out. On the other hand, boom lowering action is not carried out unless the operator carries out operation. Therefore, on the premise that boom lowering operation is not carried out by the operator, if the pin-to-target surface distance H2 is equal to or longer than the pin-to-bucket distance Dpb, it can be determined that there is no possibility that the bucket 10 enters the target surface St when operation of the arm 9 is carried out, and it can be said that the posture of the work device 1A at the time is not the entry posture.

Thus, the intervention deactivation calculating section 43*f* according to the present embodiment determines that the posture of the work device 1A is not the entry posture when the pin-to-target surface distance H2 is equal to or longer than the pin-to-bucket distance Dpb, and determines that the posture of the work device 1A is the entry posture when the pin-to-target surface distance H2 is shorter than the pin-to-bucket distance Dpb.

—Second Entry Posture Determination Processing (Second Bucket Entry Determination Processing)—

Moreover, the intervention deactivation calculating section 43*f* executes processing of determining whether or not the posture of the work device 1A is the entry posture (second entry posture determination processing) on the basis of the angle φ calculated in the posture calculating section 43*b*. The second entry posture determination processing is equivalent to processing of determining whether or not there is a possibility that the bucket 10 enters the target surface St (second bucket entry determination processing) by discriminating whether the bucket 10 moves in such a direction as to get closer to the target surface St or moves in such a direction as to get farther away from the target surface St when operation of the arm 9 is carried out.

When arm crowding operation is carried out in the case in which the angle φ is larger than 90°, the tip part of the bucket 10 moves in such a direction as to get farther away from the target surface St that exists in the travelling direction of the bucket 10 (direction toward the near side as viewed from the machine body 1B). Thus, it can be determined that there is no possibility that the bucket 10 enters the target surface St when operation of the arm 9 is carried out, and it can be said that the posture of the work device 1A at the time is not the entry posture. When arm crowding operation is carried out in the case in which the angle φ is smaller than 90°, the tip part of the bucket 10 moves in such a direction as to get closer to the target surface St that exists in the travelling direction of the bucket 10 (direction toward the near side as viewed from the machine body 1B). Thus, it can be determined that there is a possibility that the bucket 10 enters the target surface St when operation of the arm 9 is carried out, and it can be said that the posture of the work device 1A at the time is the entry posture.

When arm dumping operation is carried out in the case in which the angle φ is larger than 90°, the tip part of the bucket 10 moves in such a direction as to get closer to the target surface St that exists in the travelling direction of the bucket 10 (direction toward the far side as viewed from the machine body 1B). Thus, it can be determined that there is a possibility that the bucket 10 enters the target surface St when operation of the arm 9 is carried out, and it can be said that the posture of the work device 1A at the time is the entry posture. When arm dumping operation is carried out in the case in which the angle φ is smaller than 90°, the tip part of the bucket 10 moves in such a direction as to get farther away from the target surface St that exists in the travelling direction of the bucket 10 (direction toward the far side as viewed from the machine body 1B). Thus, it can be determined that there is no possibility that the bucket 10 enters the target surface St when operation of the arm 9 is carried out, and it can be said that the posture of the work device 1A at the time is not the entry posture.

Thus, when the angle φ is equal to or larger than 90°, the intervention deactivation calculating section 43*f* according to the present embodiment determines that the posture of the work device 1A is not the entry posture with which the bucket 10 enters the target surface St when arm crowding operation is carried out. Furthermore, when the angle φ is smaller than 90°, the intervention deactivation calculating section 43*f* determines that the posture of the work device 1A is the entry posture with which the bucket 10 enters the target surface St when arm crowding operation is carried out. Moreover, the intervention deactivation calculating section 43*f*, when the angle φ is smaller than 90°, determines that the posture of the work device 1A is not the entry posture with which the bucket 10 enters the target surface St when arm dumping operation is carried out. Furthermore, the intervention deactivation calculating section 43*f*, when the angle φ is equal to or larger than 90°, determines that the posture of the work device 1A is the entry posture with which the bucket 10 enters the target surface St when arm dumping operation is carried out.

The second entry posture determination processing is based on the premise that combined operation of lowering operation of the boom 8 and operation of the arm 9 is not being carried out similarly to the first entry posture determination processing. Thus, it is preferable that, when combined operation of lowering operation of the boom 8 and operation of the arm 9 is being carried out, the intervention deactivation calculating section 43*f* determines there is a possibility that the bucket 10 enters the target surface St even when the posture of the work device 1A is not the entry posture. That is, it is preferable that the intervention deactivation calculating section 43*f* determines that (condition 2) is not satisfied.

That is, in the present embodiment, (condition 2) holds when the following (a1) or (b1) is satisfied, and does not hold when neither (a1) nor (b1) is satisfied.

(a1) Combined operation of lowering operation of the boom 8 and operation of the arm 9 is not being carried out and it is determined that the posture of the work device 1A is not the entry posture in the first entry posture determination processing.

(b1) Combined operation of lowering operation of the boom 8 and operation of the arm 9 is not being carried out and it is determined that the posture of the work device 1A is not the entry posture in the second entry posture determination processing.

When a configuration is made in which an image to make an instruction to carry out only arm operation without carrying out boom lowering operation is displayed on the display device 53*a* by the MG or the boom lowering operation is disabled when the ground leveling control mode is set by the control mode changeover switch, whether or not holding of condition (2) is necessary may be determined depending on whether or not the work posture is the entry posture irrespective of whether or not combined operation of boom lowering operation and arm operation is being carried out.

That is, in this case, (condition 2) holds when the following (a2) or (b2) is satisfied, and does not hold when neither (a2) nor (b2) is satisfied.

(a2) It is determined that the posture of the work device 1A is not the entry posture in the first entry posture determination processing.

(b2) It is determined that the posture of the work device 1A is not the entry posture in the second entry posture determination processing.

The valve command calculating section 43*g*, in order to cause the target pilot pressures output from the intervention deactivation calculating section 43*f* to act on the respective flow control valves 15*a*, 15*b*, and 15*c*, calculates electrical signals to be output to the solenoid proportional valves 54, 55, and 56 and outputs the calculated electrical signals (excitation currents) to the solenoid proportional valves 54, 55, and 56. The solenoids of the solenoid proportional valves 54, 55, and 56 are excited by the electrical signals (excitation currents) output from the valve command calculating section 43*g*. Thereby, the solenoid proportional valves 54, 55, and 56 are actuated and the pilot pressures that act on the flow control valves 15*a*, 15*b*, and 15*c* are controlled to the target pilot pressures set in the intervention deactivation calculating section 43*f*.

Therefore, when operation (full operation) of the arm 9 is being carried out in the state in which the ground leveling control mode is set and in the case in which the intervention deactivation condition does not hold, control in which the pilot pressure as the first control signal is reduced by the solenoid proportional valve 55 and the pilot pressure as the second control signal is generated, i.e. the deceleration control in which the arm 9 is controlled at velocity lower than the velocity according to the operation by the operator, is carried out. In other words, in the case in which the ground leveling control mode is set, when the bucket-to-target surface distance H1 becomes the state of being shorter than the predetermined distance Ya defined in advance from the state of being longer than the predetermined distance Ya due to action of the arm 9 through operation of the operation lever 22*b* to the maximum by the operator, the velocity of the arm 9 is controlled to be reduced if (condition 2) does not hold. On the other hand, in the case in which the ground leveling control is being carried out and the intervention deactivation condition holds, the solenoid proportional valve 55 is set to the opened state (in the present embodiment, fully-opened state), thus the arm 9 is controlled at the velocity according to operation by the operator. That is, the deceleration control of the arm 9 is not carried out and the state in which the deceleration control is deactivated is made.

Moreover, in the present embodiment, the determination processing of whether or not holding of the intervention deactivation condition is necessary is not executed only regarding the closest target surface St but executed regarding the target surface St that exists in the travelling direction of the bucket 10 when operation of the arm 9 is carried out. With reference to flowcharts of FIG. 10 and FIG. 11, detailed description will be made below about calculation processing executed by the controller 40 as the posture calculating section 43*b* and the intervention deactivation calculating section 43*f*.

Figure 10:
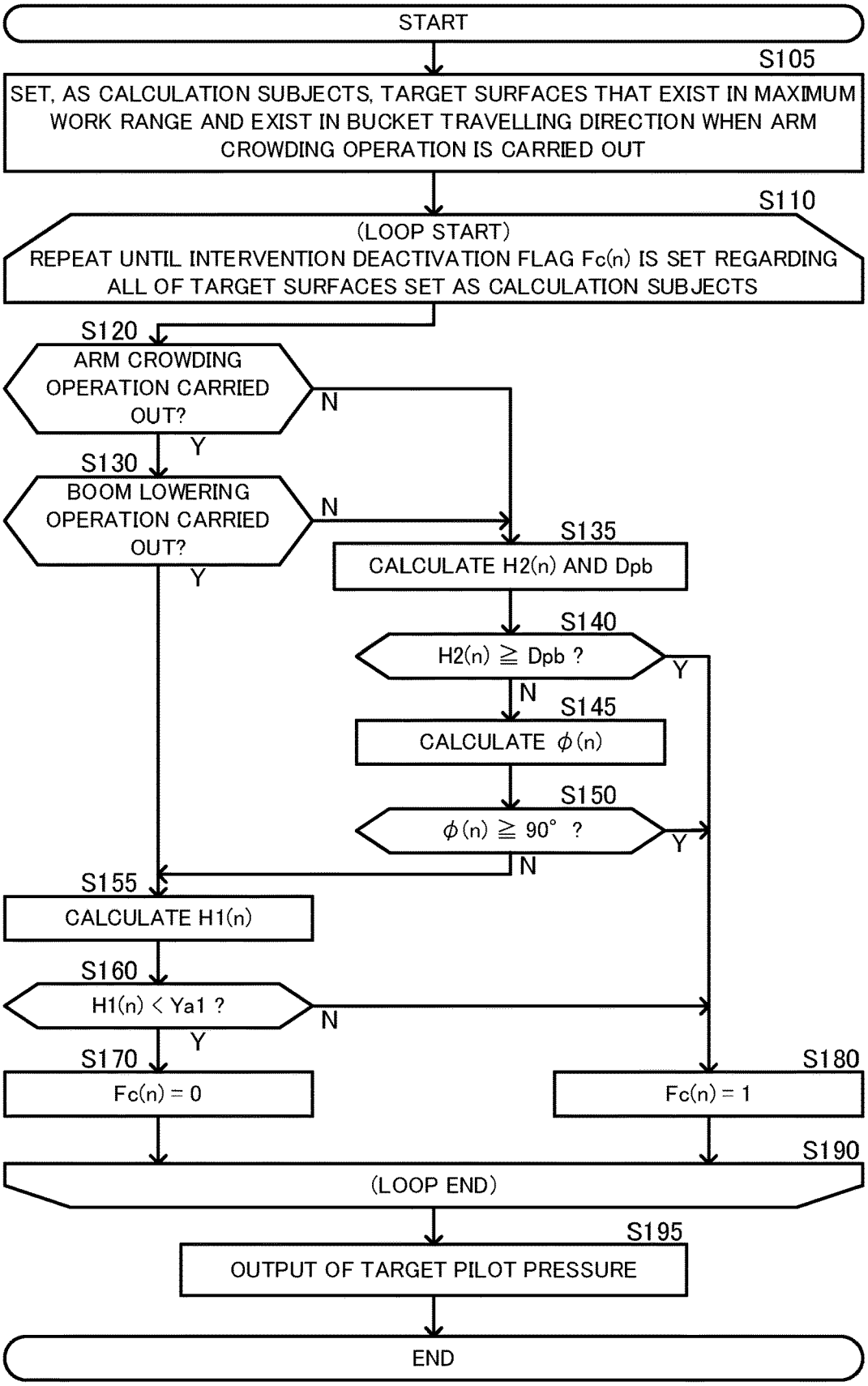
FIG. 10 is a flowchart illustrating the contents of setting processing of an intervention deactivation flag Fc(n) for arm crowding executed by the controller according to a first embodiment.
Figure 11:
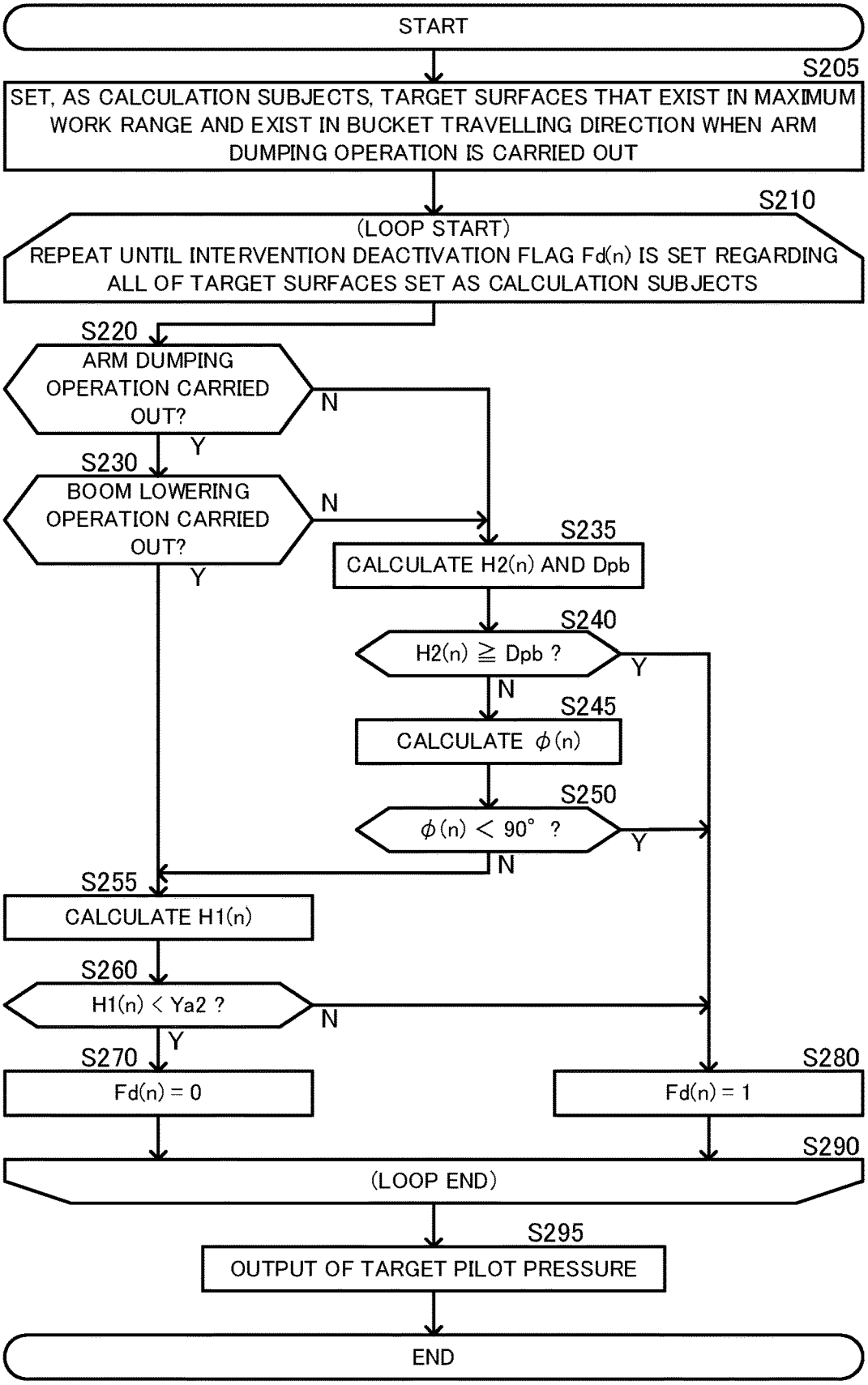
FIG. 11 is a flowchart illustrating the contents of setting processing of an intervention deactivation flag Fd(n) for arm dumping executed by the controller according to a first embodiment.

FIG. 10 is a flowchart illustrating the contents of setting processing of an intervention deactivation flag Fc(n) for arm crowding executed by the controller 40. FIG. 11 is a flowchart illustrating the contents of setting processing of an intervention deactivation flag Fd(n) for arm dumping executed by the controller 40. The processing of the flowcharts illustrated in FIG. 10 and FIG. 11 is started due to setting of the ground leveling control mode by the control mode changeover switch or the like that is not illustrated in the diagram, and is repeatedly executed at a predetermined control cycle after initial setting that is not illustrated in the diagram is carried out.

As illustrated in FIG. 10, in a step S105, the intervention deactivation calculating section 43*f* calculates the maximum work range of the work device 1A. Furthermore, in the step S105, the intervention deactivation calculating section 43*f* sets, as calculation subjects, the closest target surface St(0) and the near-side target surface St(n), (n<0) that are target surfaces exist in the maximum work range and exist in the travelling direction of the bucket 10 when arm crowding operation is carried out. Then, progress to a step S110 is made. When the character n given to the target surface St(n) located on the nearest side in the target surfaces St(n) set as the calculation subjects is deemed as m (m<0), the character n given to the target surfaces St(n) that are the calculation subjects is n=m, m+1, . . . −1, 0. In the example illustrated in FIG. 8, the target surfaces St(n), (n=−3, −2, −1, 0) are set as the calculation subjects. The maximum work range is the largest range of the reach of the tip part of the bucket 10 and is calculated based on a maximum work radius R when the boom 8, the arm 9, and the bucket 10 are stretched into a straight line shape, the pivot range of each member that configures the work device 1A, and so forth. The maximum work radius R and the pivot range of each member that configures the work device 1A are stored in the storing device of the controller 40 in advance.

After the processing of setting the target surfaces St(n) in the work range as the calculation subjects (S105) is completed, the controller 40 executes loop processing in which a series of processing from a step S120 to a step S170 or a step S180 is repeatedly executed (steps S110 and S190). The step S110 represents the start of the loop and the step S190 represents the end of the loop. This loop processing (steps S110 and S190) ends when the intervention deactivation flag Fc(n) has been set regarding all of the target surfaces St(n), (n=m to 0) set as the calculation subjects. Upon the end of the loop processing, progress to a step S195 is made.

In the step S120, the intervention deactivation calculating section 43*f* determines whether or not arm crowding operation is being carried out, on the basis of a calculation result in the operation amount calculating section 43*a*. The intervention deactivation calculating section 43*f*, when an operation amount Ac of arm crowding calculated in the operation amount calculating section 43*a* is equal to or larger than a threshold Ac0, determines that arm crowding operation is being carried out, and progress to the step S130 is made. The intervention deactivation calculating section 43*f*, when the arm crowding operation amount Ac calculated in the operation amount calculating section 43*a* is smaller than the threshold Ac0, determines that arm crowding operation is not being carried out, and progress to the step S135 is made. The threshold Ac0 is a threshold for determining whether or not arm crowding operation is being carried out and is stored in the storing device of the controller 40 in advance.

In the step S130, the intervention deactivation calculating section 43*f* determines whether or not boom lowering operation is being carried out, on the basis of a calculation result in the operation amount calculating section 43*a*. The intervention deactivation calculating section 43*f*, when an operation amount Bl of boom lowering calculated in the operation amount calculating section 43*a* is equal to or larger than a threshold Bl0, determines that boom lowering operation is being carried out, and progress to the step S155 is made. The intervention deactivation calculating section 43*f*, when the boom lowering operation amount Bl calculated in the operation amount calculating section 43*a* is smaller than the threshold Bl0, determines that boom lowering operation is not being carried out, and progress to the step S135 is made. The threshold Bl0 is a threshold for determining whether or not boom lowering operation is being carried out and is stored in the storing device of the controller 40 in advance.

In the step S135, the posture calculating section 43*b* calculates the pin-to-target surface distance H2(*n*) and the pin-to-bucket distance Dpb, and progress to the step S140 is made. In the step S140, the intervention deactivation calculating section 43*f* determines whether or not the pin-to-target surface distance H2(*n*) calculated in the posture calculating section 43*b* is equal to or longer than the pin-to-bucket distance Dpb calculated in the posture calculating section 43*b*.

When it is determined in the step S140 that the pin-to-target surface distance H2(*n*) is equal to or longer than the pin-to-bucket distance Dpb, i.e. when it is determined that the posture of the work device 1A is not the entry posture and there is no possibility that the bucket 10 enters the target surface St(n) due to arm crowding operation, progress to the step S180 is made. When it is determined in the step S140 that the pin-to-target surface distance H2(*n*) is shorter than the pin-to-bucket distance Dpb, i.e. when it is determined that the posture of the work device 1A is the entry posture and there is a possibility that the bucket 10 enters the target surface St(n) due to arm crowding operation, progress to the step S145 is made.

In the step S145, the posture calculating section 43*b* calculates the angle φ(n), and progress to the step S150 is made. In the step S150, the intervention deactivation calculating section 43*f* determines whether or not the angle φ(n) calculated in the posture calculating section 43*b* is equal to or larger than 90°.

When it is determined in the step S150 that the angle φ(n) is equal to or larger than 90°, i.e. when it is determined that the posture of the work device 1A is not the entry posture and there is no possibility that the bucket 10 enters the target surface St(n) due to arm crowding operation, progress to the step S180 is made. When it is determined in the step S150 that the angle φ(n) is smaller than 90°, i.e. when it is determined that the posture of the work device 1A is the entry posture and there is a possibility that the bucket 10 enters the target surface St(n) due to arm crowding operation, progress to the step S155 is made.

In the step S155, the posture calculating section 43*b* calculates the bucket-to-target surface distance H1(*n*), and progress to the step S160 is made. In the step S160, the intervention deactivation calculating section 43*f* determines whether or not the bucket-to-target surface distance H1(*n*) calculated in the posture calculating section 43*b* is shorter than the threshold Ya1. When it is determined in the step S160 that the distance H1(*n*) is shorter than the threshold Ya1, progress to the step S170 is made. When it is determined that the distance H1(*n*) is equal to or longer than the threshold Ya1, progress to the step S180 is made.

In the step S170, the intervention deactivation calculating section 43*f* determines that the intervention deactivation condition does not hold (in other words, arm crowding deceleration condition holds), and sets the intervention deactivation flag Fc(n) to 0 (Fc(n)=0). Then, progress to the step S190 is made to end the series of processing regarding the relevant target surface St(n).

In the step S180, the intervention deactivation calculating section 43*f* determines that the intervention deactivation condition holds (in other words, arm crowding deceleration condition does not hold), and sets the intervention deactivation flag Fc(n) to 1 (Fc(n)=1). Then, progress to the step S190 is made to end the series of processing regarding the relevant target surface St(n).

When the loop processing is completed, progress to the step S195 is made and target pilot pressure output processing is executed. In the step S195, the intervention deactivation calculating section 43*f* determines whether or not all of the intervention deactivation flags Fc(n), (n=m to 0) are set to Fc(n)=1, and outputs the target pilot pressure on the basis of the determination. When it is determined that all of the intervention deactivation flags Fc(n) are not set to Fc(n)=1, i.e. when even one of the intervention deactivation flags Fc(n), (n=m to 0) is determined to be set to Fc(n)=0, the intervention deactivation calculating section 43*f* outputs, to the valve command calculating section 43*g*, the target pilot pressure for the hydraulic drive part 151*a* of the flow control valve 15*b* calculated in the target pilot pressure calculating section 43*e* as it is. Due to this, the deceleration control of the arm 9 is carried out and arm crowding action is carried out at velocity lower than the velocity according to operation by the operator.

On the other hand, when it is determined that all of the intervention deactivation flags Fc(n), (n=m to 0) are set to Fc(n)=1, the intervention deactivation calculating section 43*f* sets the maximum pressure Pmax as the target pilot pressure for the hydraulic drive part 151*a* of the flow control valve 15*b* irrespective of the calculation result in the target pilot pressure calculating section 43*e* and outputs the maximum pressure Pmax to the valve command calculating section 43*g*. Due to this, the solenoid proportional valve 55*a* capable of controlling arm crowding action is controlled to the fully-opened state. That is, the deceleration control of the arm 9 is not carried out. As a result, arm crowding action is carried out at the velocity according to operation by the operator. When the target pilot pressure output processing (S195) ends, the processing illustrated in the flowchart of FIG. 10 ends.

As illustrated in FIG. 11, in a step S205, the intervention deactivation calculating section 43*f* calculates the maximum work range of the work device 1A. Furthermore, in the step S205, the intervention deactivation calculating section 43*f* sets, as calculation subjects, the closest target surface St(0) and the far-side target surface St(n), (n>0) that are target surfaces exist in the maximum work range and exist in the travelling direction of the bucket 10 when arm dumping operation is carried out. Then, progress to a step S210 is made. When the character n given to the target surface St(n) located on the farthest side in the target surfaces St(n) set as the calculation subjects is deemed as q (q>0), the character n given to the target surfaces St(n) that are the calculation subjects is n=0, 1, . . . q−1, q. In the example illustrated in FIG. 8, the target surfaces St(n), (n=0, 1) are set as the calculation subjects.

After the processing of setting the target surfaces St(n) in the work range as the calculation subjects (S205) is completed, the controller 40 executes loop processing in which a series of processing from a step S220 to a step S270 or a step S280 is repeatedly executed (steps S210 and S290). The step S210 represents the start of the loop and the step S290 represents the end of the loop. This loop processing (steps S210 and S290) ends when the intervention deactivation flag Fd(n) has been set regarding all of the target surfaces St(n), (n=0 to q) set as the calculation subjects. Upon the end of the loop processing, progress to a step S295 is made.

In the step S220, the intervention deactivation calculating section 43*f* determines whether or not arm dumping operation is being carried out, on the basis of a calculation result in the operation amount calculating section 43*a*. The intervention deactivation calculating section 43*f*, when an operation amount Ad of arm dumping calculated in the operation amount calculating section 43*a* is equal to or larger than a threshold Ad0, determines that arm dumping operation is being carried out, and progress to the step S230 is made. The intervention deactivation calculating section 43*f*, when the arm dumping operation amount Ad calculated in the operation amount calculating section 43*a* is smaller than the threshold Ad0, determines that arm dumping operation is not being carried out, and progress to the step S235 is made. The threshold Ad0 is a threshold for determining whether or not arm dumping operation is being carried out and is stored in the storing device of the controller 40 in advance.

In the step S230, processing similar to the step S130 is executed. When it is determined in the step S230 that boom lowering operation is being carried out, progress to the step S255 is made. When it is determined that boom lowering operation is not being carried out, progress to the step S235 is made.

In the step S235, the posture calculating section 43*b* calculates the pin-to-target surface distance H2(*n*) and the pin-to-bucket distance Dpb, and progress to the step S240 is made. In the step S240, the intervention deactivation calculating section 43*f* determines whether or not the pin-to-target surface distance H2(*n*) calculated in the posture calculating section 43*b* is equal to or longer than the pin-to-bucket distance Dpb calculated in the posture calculating section 43*b*.

When it is determined in the step S240 that the pin-to-target surface distance H2(*n*) is equal to or longer than the pin-to-bucket distance Dpb, i.e. when it is determined that the posture of the work device 1A is not the entry posture and there is no possibility that the bucket 10 enters the target surface St(n) due to arm dumping operation, progress to the step S280 is made. When it is determined in the step S240 that the pin-to-target surface distance H2(*n*) is shorter than the pin-to-bucket distance Dpb, i.e. when it is determined that the posture of the work device 1A is the entry posture and there is a possibility that the bucket 10 enters the target surface St(n) due to arm dumping operation, progress to the step S245 is made.

In the step S245, the posture calculating section 43*b* calculates the angle φ(n), and progress to the step S250 is made. In the step S250, the intervention deactivation calculating section 43*f* determines whether or not the angle φ(n) calculated in the posture calculating section 43*b* is smaller than 90°.

When it is determined in the step S250 that the angle φ(n) is smaller than 90°, i.e. when it is determined that the posture of the work device 1A is not the entry posture and there is no possibility that the bucket 10 enters the target surface St(n) due to arm dumping operation, progress to the step S280 is made. When it is determined in the step S250 that the angle φ(n) is equal to or larger than 90°, i.e. when it is determined that the posture of the work device 1A is the entry posture and there is a possibility that the bucket 10 enters the target surface St(n) due to arm dumping operation, progress to the step S255 is made.

In the step S255, the posture calculating section 43*b* calculates the bucket-to-target surface distance H1(*n*), and progress to the step S260 is made. In the step S260, the intervention deactivation calculating section 43*f* determines whether or not the bucket-to-target surface distance H1(*n*) calculated in the posture calculating section 43*b* is shorter than the threshold Ya2. When it is determined in the step S260 that the distance H1(*n*) is shorter than the threshold Ya2, progress to the step S270 is made. When it is determined that the distance H1(*n*) is equal to or longer than the threshold Ya2, progress to the step S280 is made.

In the step S270, the intervention deactivation calculating section 43*f* determines that the intervention deactivation condition does not hold (in other words, arm dumping deceleration condition holds), and sets the intervention deactivation flag Fd(n) to 0 (Fd(n)=0). Then, progress to the step S290 is made to end the series of processing regarding the relevant target surface St(n).

In the step S280, the intervention deactivation calculating section 43*f* determines that the intervention deactivation condition holds (in other words, arm dumping deceleration condition does not hold), and sets the intervention deactivation flag Fd(n) to 1 (Fd(n)=1). Then, progress to the step S290 is made to end the series of processing regarding the relevant target surface St(n).

When the loop processing is completed, progress to the step S295 is made and target pilot pressure output processing is executed. In the step S295, the intervention deactivation calculating section 43*f* determines whether or not all of the intervention deactivation flags Fd(n), (n=0 to q) are set to Fd(n)=1, and outputs the target pilot pressure on the basis of the determination result. When it is determined that all of the intervention deactivation flags Fd(n) are not set to Fd(n)=1, i.e. when even one of the intervention deactivation flags Fd(n), (n=0 to q) is determined to be set to Fd(n)=0, the intervention deactivation calculating section 43*f* outputs, to the valve command calculating section 43*g*, the target pilot pressure for the hydraulic drive part 151*b* of the flow control valve 15*b* calculated in the target pilot pressure calculating section 43*e* as it is. Due to this, the deceleration control of the arm 9 is carried out and arm dumping action is carried out at velocity lower than the velocity according to operation by the operator.

On the other hand, when it is determined that all of the intervention deactivation flags Fd(n), (n=0 to q) are set to Fd(n)=1, the intervention deactivation calculating section 43*f* sets the maximum pressure Pmax as the target pilot pressure for the hydraulic drive part 151*b* of the flow control valve 15*b* irrespective of the calculation result in the target pilot pressure calculating section 43*e* and outputs the maximum pressure Pmax to the valve command calculating section 43*g*. Due to this, the solenoid proportional valve 55*b* capable of controlling arm dumping action is controlled to the fully-opened state. That is, the deceleration control of the arm 9 is not carried out. As a result, arm dumping action is carried out at the velocity according to operation by the operator. When the target pilot pressure output processing (S295) ends, the processing illustrated in the flowchart of FIG. 11 ends.

Figure 12:
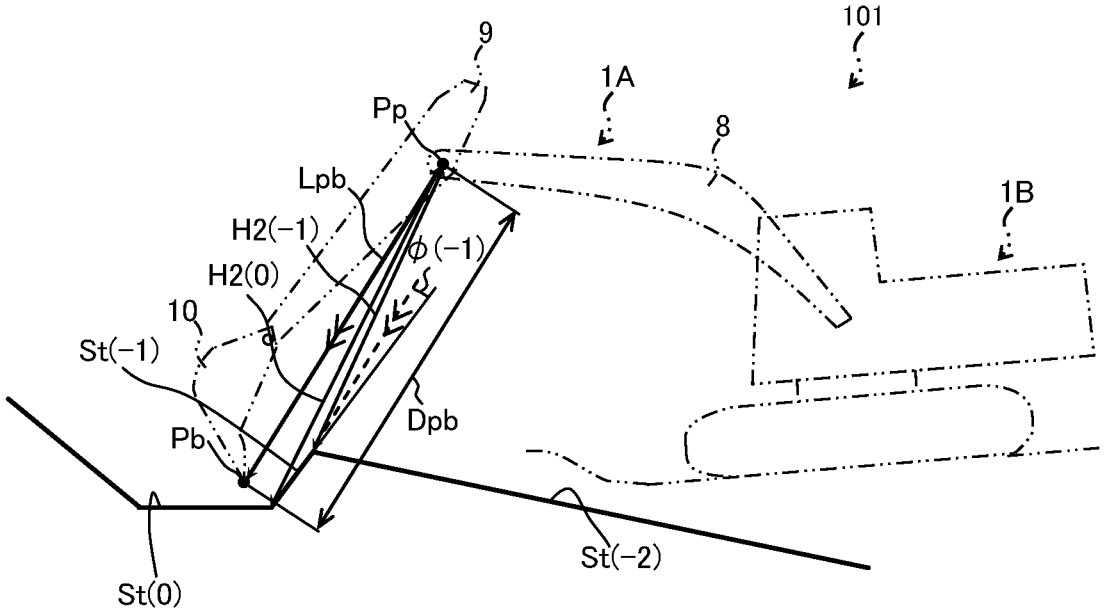
FIG. 12 is a diagram for explaining the case in which it is determined that there is a possibility that the bucket enters a target surface St(−1) set in the direction in which the bucket travels due to arm crowding operation.
Figure 13A:
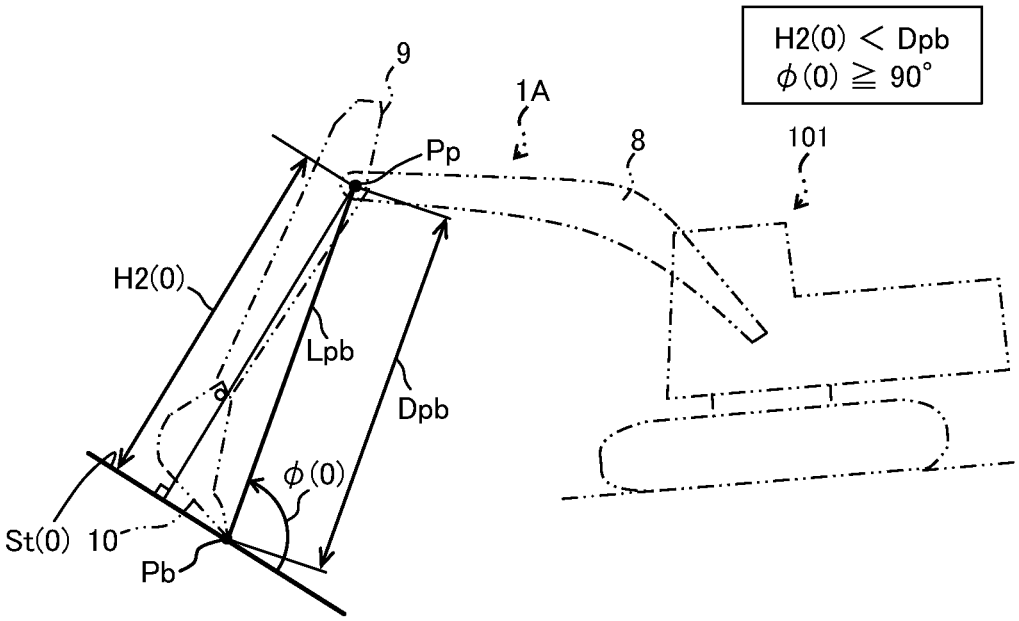
FIG. 13A is a diagram illustrating the state in which arm crowding deceleration control is deactivated because an angle φ formed by a line segment Lpb and a target surface St(0) is equal to or larger than 90°.
Figure 13B:
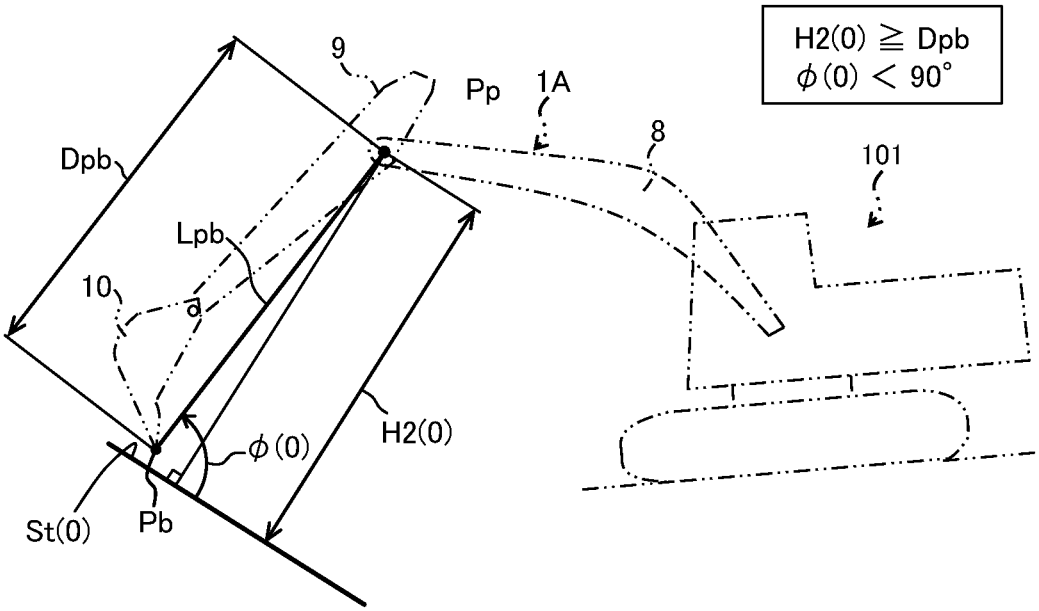
FIG. 13B is a diagram illustrating the state in which the arm crowding deceleration control is deactivated because a pin-to-target surface distance H2(0) is equal to or longer than a pin-to-bucket distance Dpb.

A specific example of operation of the work device 1A and a specific example of whether or not execution of the deceleration control is possible according to the posture of the work device 1A will be described with reference to FIG. 8, FIG. 9, FIG. 12, FIG. 13A, and FIG. 13B. FIG. 12 is a diagram for explaining the case in which it is determined that there is a possibility that the bucket 10 enters the target surface St(−1) set in the direction in which the bucket 10 travels due to arm crowding operation. FIG. 13A is a diagram illustrating the state in which the arm crowding deceleration control is deactivated because the angle φ formed by the line segment Lpb and the target surface St(0) is equal to or larger than 90°. FIG. 13B is a diagram illustrating the state in which the arm crowding deceleration control is deactivated because the pin-to-target surface distance H2(0) is equal to or longer than the pin-to-bucket distance Dpb.

As illustrated in FIG. 9, for example, when the operator operates the operation device 45 with an aim at horizontal excavation by arm crowding action, the solenoid proportional valves 54*a* and 55*a* are controlled according to the situation in such a manner that the tip part of the bucket 10 is kept from entering a region on the lower side of the target surface St. In this case, deceleration operation of arm crowding and boom raising action are automatically combined with the arm crowding action according to the operation by the operator and the horizontal excavation operation is carried out by only the arm crowding operation with achievement of assistance by the controller 40.

In the present embodiment, when combined operation of lowering operation of the boom 8 and operation of the arm 9 is not being carried out, if it is determined that the posture of the work device 1A is not the entry posture, i.e. if it is determined that there is no possibility that the bucket 10 enters the target surface St when operation of the arm 9 is carried out, the target pilot pressure for the flow control valve 15*b* is set to the maximum pressure and the degree of opening of the solenoid proportional valve 55 becomes fully-opened.

When operation of the arm 9 is not being carried out (when the target pilot pressure is calculated as the minimum value), the degree of opening of the solenoid proportional valve 55 is set to the minimum degree of opening in the case in which it is determined that the posture of the work device 1A is the entry posture (that is, it is determined that there is a possibility that the bucket 10 enters the target surface when operation of the arm 9 is carried out) in each the first entry posture determination processing and the second entry posture determination processing and it is determined that the bucket-to-target surface distance H1(*n*) is shorter than the predetermined distance Ya (for example, N in S120 in FIG. 10→N in S140→N in S150→Y in S160→S170). Due to this, it is possible to prevent the occurrence of the situation in which the arm 9 suddenly rushes and the tip part of the bucket 10 enters the target surface St when a transition is made from the arm-non-operated state to the arm-operated state.

When the arm 9 is not being operated, the degree of opening of the solenoid proportional valve 55 is set to the maximum degree of opening (fully-opened) in the case in which it is determined that the posture of the work device 1A is not the entry posture (for example, N in S120 in FIG. 10→Y in S140→S180, or N in S120→N in S140→Y in S150→S180). Furthermore, when the arm 9 is not being operated, the degree of opening of the solenoid proportional valve 55 is set to the maximum degree of opening (fully-opened) when it is determined that the bucket-to-target surface distance H1(*n*) is equal to or longer than the predetermined distance Ya in the case in which it has been determined that the posture of the work device 1A is the entry posture in each the first entry posture determination processing and the second entry posture determination processing (for example, N in S120 in FIG. 10→N in S140→N in S150→N in S160→S180). Therefore, the arm 9 can be caused to rapidly make action according to the operation by the operator when a transition is made from the arm-non-operated state to the arm-operated state. Thus, work of excavation, ground leveling, or the like can be efficiently carried out.

When plural target surfaces St(n) are set as illustrated in FIG. 8, the controller 40 determines whether or not there is a possibility of entry of the bucket 10 regarding the target surfaces St(n), (n=−3, −2, −1, 0, 1) that exist in the maximum work range of the bucket 10 in the set plural target surfaces St(n).

Therefore, there is no need to execute various kinds of calculation processing for determining whether or not there is a possibility of entry of the bucket 10 regarding all of the set plural target surfaces St(n). Thus, the load of the calculation by the controller 40 can be reduced.

Furthermore, in the setting processing of the intervention deactivation flag Fc(n) for arm crowding, regarding the target surfaces St(n), (n=−3, −2, −1, 0) that are the target surfaces existing in the maximum work range of the bucket 10 and exist in the travelling direction of the bucket 10 when arm crowding operation is carried out, it is determined whether or not there is a possibility that the bucket 10 enters the target surface St(n), (n=−3, −2, −1, 0) when arm crowding operation is carried out. Similarly, in the setting processing of the intervention deactivation flag Fd(n) for arm dumping, regarding the target surfaces St(n), (n=0, 1) that are the target surfaces existing in the maximum work range of the bucket 10 and exist in the travelling direction of the bucket 10 when arm dumping operation is carried out, it is determined whether or not there is a possibility that the bucket 10 enters the target surface St(n), (n=0, 1) when arm dumping operation is carried out.

In the case in which it is determined whether or not there is a possibility of entry of the bucket 10 due to operation of the arm 9 only regarding the closest target surface St(0), there is a fear that shock attributed to a transition of the state between the deceleration control state (state in which the deceleration control is being carried out) and the deactivation state of the deceleration control (state in which the deceleration control is not being carried out) occurs when the closest target surface St(0) is switched to the adjacent target surface St(1) or St(−1). In contrast, the controller 40 according to the present embodiment determines whether or not there is a possibility of entry of the bucket 10 regarding not only the closest target surface St(0) but the target surface St(n) set in the direction in which the bucket 10 travels. Then, on the basis of the determination result, the controller 40 decides whether to carry out the deceleration control or not to carry out it (to deactivate the deceleration control). In the present embodiment, the deceleration control of the arm 9 is carried out when the bucket-to-target surface distance H1(*n*) is shorter than the threshold Ya and even one target surface St(n) involving a possibility that the bucket 10 enters the target surface St(n) when operation of the arm 9 is carried out is determined to exist in the target surface St(n) that exist in the travelling direction of the bucket 10. Due to this, in the case in which plural target surfaces are set, it is possible to prevent the occurrence of shock attributed to a transition of the state between the deceleration control state and the deactivation state of the deceleration control when the closest target surface St(0) is switched to the adjacent target surface St(1) or St(−1) due to operation of the arm 9. This allows the arm 9 to smoothly make action. Therefore, the operability is high and improvement in the work efficiency can be intended.

In the example illustrated in FIG. 8, the distances H2(0), H2(−1), H2(−2), and H2(−3) are equal to or longer than the distance Dpb. Thus, the intervention deactivation flags Fc(n) with n=−3, −2, −1, 0 are each set to 1 (Fc(n)=1, n=−3, −2, −1, 0). Therefore, when arm crowding operation is carried out, the deceleration control of the arm 9 is not carried out (Y in S140 in FIG. 10→S180).

Furthermore, in the example illustrated in FIG. 8, the distance H2(0) and the distance H2(1) are equal to or longer than the distance Dpb. Thus, the intervention deactivation flags Fd(n) with n=0, 1 are each set to 1 (Fd(n)=1, n=0, 1). Therefore, when arm dumping operation is carried out, the deceleration control of the arm 9 is not carried out (Y in S240 in FIG. 11→S280).

In the example illustrated in FIG. 12, the distance H2(0) is equal to or longer than the distance Dpb and the intervention deactivation flag Fc(0) is set to 1 (Y in S140 in FIG. 10→S180). However, the distance H2(−1) is shorter than the distance Dpb and the angle φ(−1) is smaller than 90°. Thus, it is determined that, when arm crowding operation is carried out, the bucket 10 comes closer to the target surface St(−1) that exists in the travelling direction thereof (direction toward the near side as viewed from the machine body 1B) and the bucket 10 enters the target surface St(−1). Furthermore, in this example, the distance H1(−1) is shorter than the threshold Ya1 although diagrammatic representation is not made. Thus, the intervention deactivation flag Fc(−1) is set to 0 (Fc(−1)=0). Therefore, in the example illustrated in FIG. 12, the deceleration control of the arm 9 is carried out when arm crowding operation is carried out (N in S140 regarding n=−1→N in S150→Y in S160→S170, in the flowchart illustrated in FIG. 10).

In the example illustrated in FIG. 13A, the distance H2(0) is shorter than the distance Dpb, but the angle φ(0) is equal to or larger than 90°. Therefore, it is determined that there is no possibility that the bucket 10 enters the target surface St(0) when arm crowding operation is carried out. Thus, in the example illustrated in FIG. 13A, when arm crowding operation is carried out, the deceleration control of the arm 9 is not carried out even when the distance H1(0) is shorter than the distance Ya (N in S140 in FIG. 10→Y in S150→S180). In the example illustrated in FIG. 13A, since the angle φ(0) is equal to or larger than 90°, it is determined that there is a possibility that the bucket 10 enters the target surface St(0) when arm dumping operation is carried out. Thus, in the example illustrated in FIG. 13A, the deceleration control of the arm 9 is carried out when arm dumping operation is carried out (N in S240 in FIG. 11→N in S250→Y in S260, S270).

In the example illustrated in FIG. 13B, the angle φ(0) is smaller than 90° but the distance H2(0) is equal to or longer than the distance Dpb. Therefore, it is determined that there is no possibility that the bucket 10 enters the target surface St(0) when arm crowding operation is carried out. Thus, in the example illustrated in FIG. 13B, the deceleration control of the arm 9 is not carried out even when the distance H1(0) is shorter than the distance Ya (Y in S140 in FIG. 10→S180). Similarly, in the example illustrated in FIG. 13B, the distance H2(0) is equal to or longer than the distance Dpb and therefore it is determined that there is no possibility that the bucket 10 enters the target surface St(0) when arm dumping operation is carried out. Thus, in the example illustrated in FIG. 13B, the deceleration control of the arm 9 is not carried out when arm dumping operation is carried out (Y in S240 in FIG. 11→S280).

As above, according to the present embodiment, in work in the state in which the ground leveling control mode is set, opportunities for execution of the deceleration control of the arm 9 can be reduced compared with the case in which the deceleration control of the arm 9 is carried out across the board when the bucket-to-target surface distance H1(*n*) has become shorter than the predetermined distance Ya. Due to this, for example, in the case in which, in excavation and ground leveling work, work of returning the bucket 10 to the work start point of them, work of excavating the upper side of the target surface St, work of shaking down earth from the bucket 10, and so forth are carried out in the deceleration region (H1(*n*)<Ya), limitation on action of the arm 9 is suppressed and it is possible to cause the work device 1A to carry out operation according to the intension of the operator. That is, limitation about the respective actions of arm crowding and arm dumping is alleviated even under the condition in which the action velocity of the arm 9 is limited by the MC originally (that is, when H1(*n*)<Ya). Therefore, according to the present embodiment, the work efficiency of excavation and ground leveling work by arm pulling and ground leveling work by arm pushing can be improved.

According to the above-described embodiment, the following operation and effects are provided.

(1) The hydraulic excavator (work machine) 101 according to the present embodiment includes the controller 40 that sets the target surface St, and calculates the bucket-to-target surface distance H1 that is the distance from the bucket (work equipment) 10 to the target surface St on the basis of signals from the GNSS antennas (position sensor) 14 and the angle sensors (posture sensor) 30 to 33, and controls the boom 8 and carries out the deceleration control to decelerate the arm 9 to keep the bucket 10 from excavating the ground beyond the target surface St when operation of the arm 9 is carried out by the operation device 45 and the bucket-to-target surface distance H1 has become shorter than the threshold (predetermined distance) Ya. Furthermore, the controller 40 determines whether or not there is a possibility that the bucket 10 enters the target surface St when operation of the arm 9 is carried out, on the basis of the target surface St that is set and the signals from the GNSS antennas 14 and the angle sensors 30 to 33, and does not carry out the deceleration control even when the bucket-to-target surface distance H1 is shorter than the predetermined distance Ya in the case in which it is determined that there is no possibility that the bucket 10 enters the target surface St when operation of the arm 9 is carried out.

Therefore, according to the present embodiment, when it is determined that there is a possibility that the bucket 10 enters the target surface St, the deceleration control of arm crowding (arm pulling) and the deceleration control of arm dumping (arm pushing) are carried out. Thus, the ground leveling work can be surely carried out by the machine control. On the other hand, when it is determined that there is no possibility that the bucket 10 enters the target surface St, the deceleration control of arm crowding (arm pulling) and the deceleration control of arm dumping (arm pushing) are not carried out. That is, according to the present embodiment, opportunities for execution of the deceleration control of the arm 9 can be reduced and therefore the efficiency of work of excavation, ground leveling, and so forth by the hydraulic excavator 101 can be improved.

(2) When combined operation of lowering operation of the boom 8 and operation of the arm 9 is being carried out, even in the case in which the posture of the work device 1A is not the entry posture, the deceleration control of the arm 9 by the normal MC is carried out when the bucket-to-target surface distance H1(*n*) is shorter than the predetermined distance Ya (for example, Y in S120 in FIG. 10→Y in S130→Y in S160→S170).

The step S140 and the step S150 illustrated in FIG. 10 are processing of determining whether or not the posture of the work device 1A is the entry posture with which the bucket 10 enters the target surface St(n) with only operation of the arm 9 envisaged. Thus, when combined operation of lowering operation of the boom 8 and operation of the arm 9 is being carried out, entry of the bucket 10 into the target surface St(n) can be prevented by carrying out the deceleration control of the arm 9 by the normal MC.

Second Embodiment

Figure 14:
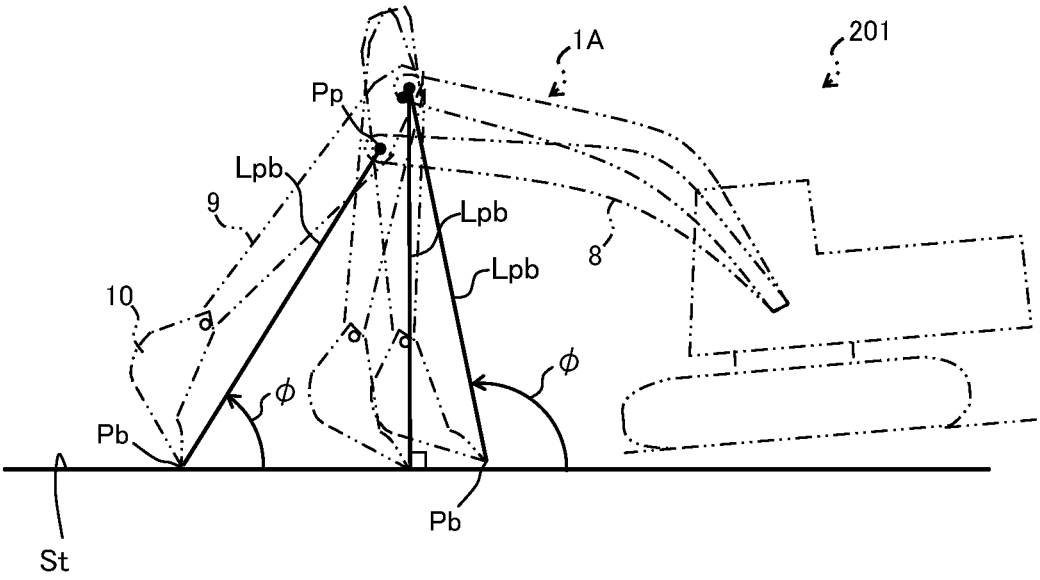
FIG. 14 is a diagram illustrating the state in which a hydraulic excavator according to a second embodiment carries out horizontal pulling (horizontal pushing).
Figure 15A:
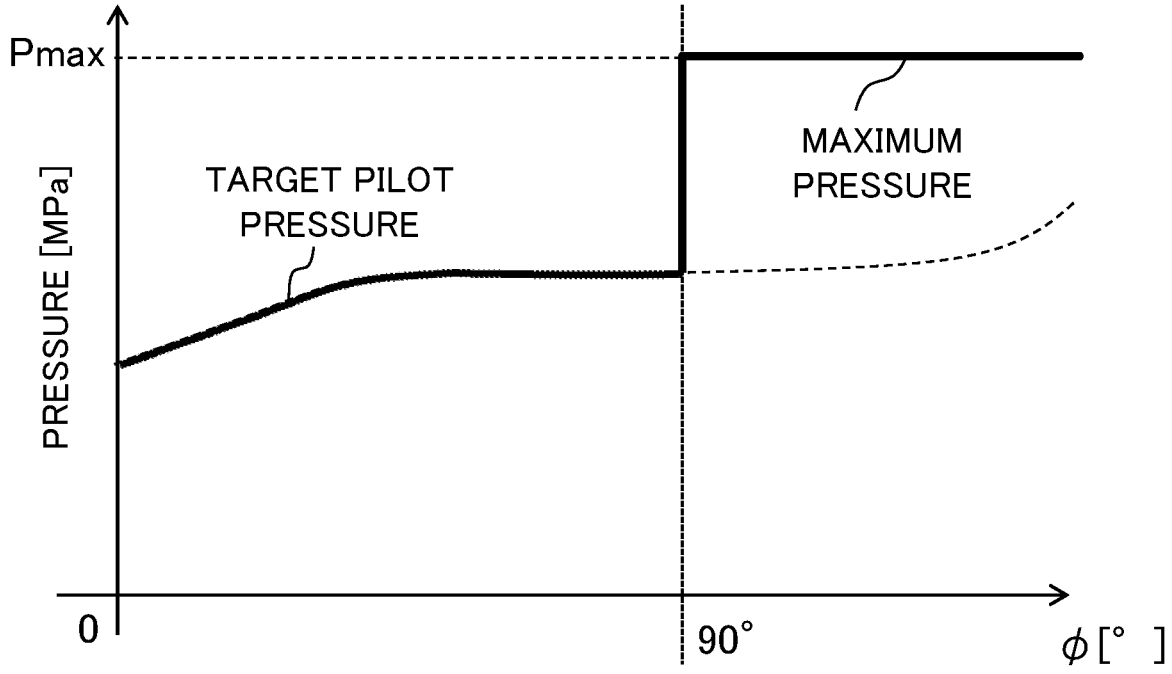
FIG. 15A is a diagram illustrating the relation between the target pilot pressure when arm crowding operation (maximum operation) is carried out and the angle φ in the hydraulic excavator according to the first embodiment.
Figure 15B:
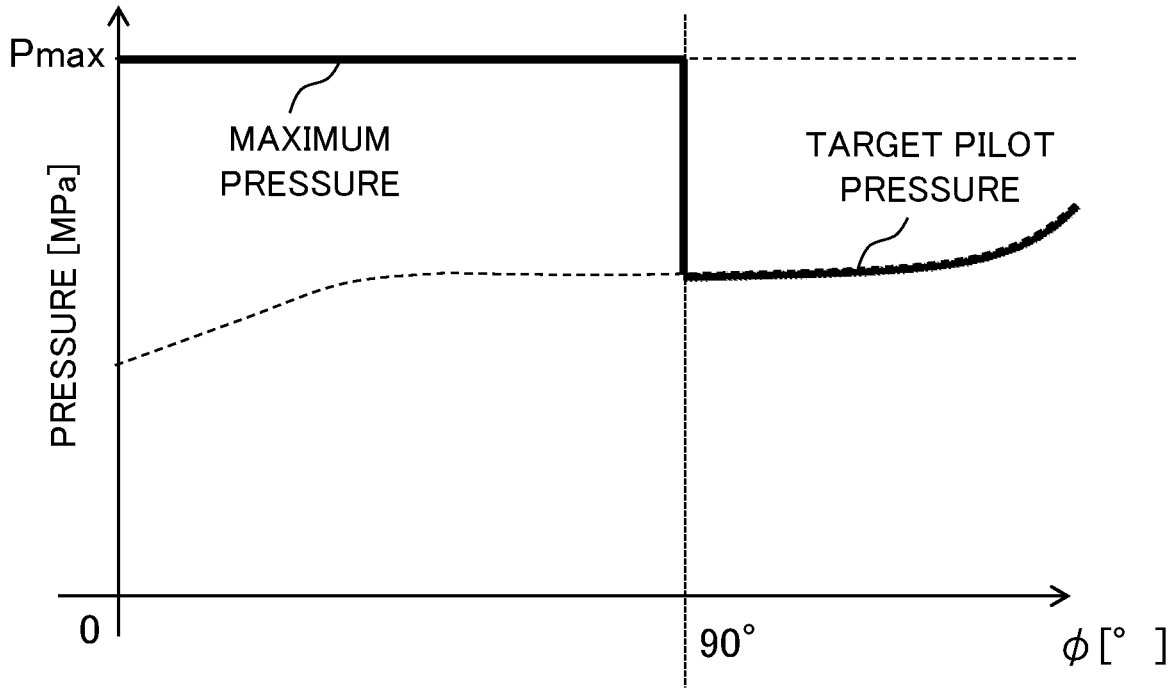
FIG. 15B is a diagram illustrating the relation between the target pilot pressure when arm dumping operation (maximum operation) is carried out and the angle φ in the hydraulic excavator according to the first embodiment.

A hydraulic excavator 201 according to a second embodiment will be described with reference to FIG. 14 to FIG. 21B. In the diagrams, a part that is the same as or equivalent to the first embodiment is given the same reference numeral and differences will be mainly described. FIG. 14 is a diagram illustrating the state in which the hydraulic excavator 201 according to the second embodiment carries out horizontal pulling (horizontal pushing). FIG. 15A is a diagram illustrating the relation between the target pilot pressure when arm crowding operation (maximum operation) is carried out and the angle φ in the hydraulic excavator 101 according to the first embodiment. FIG. 15B is a diagram illustrating the relation between the target pilot pressure when arm dumping operation (maximum operation) is carried out and the angle φ in the hydraulic excavator 101 according to the first embodiment.

The hydraulic excavator 201 according to the second embodiment has a configuration similar to the first embodiment. Here, when, as illustrated in FIG. 14, arm crowding operation is carried out to carry out work of moving the tip part of the bucket 10 along the target surface St set in parallel to the horizontal plane (horizontal pulling), the angle φ formed by the line segment Lpb and the target surface St gradually becomes larger. Furthermore, when arm dumping operation is carried out to carry out work of moving the tip part of the bucket 10 along the target surface St set in parallel to the horizontal plane (horizontal pushing), the angle φ formed by the line segment Lpb and the target surface St gradually becomes smaller.

In the case of carrying out such work, with the configuration of the above-described first embodiment, there is a fear that sudden action of the arm 9 occurs when the angle φ exceeds 90°. In the first embodiment, for example, as illustrated in FIG. 15A, the maximum pressure Pmax is set as the target pilot pressure that is the target value of the pilot pressure generated in the solenoid proportional valve 55*a* when the angle φ is equal to or larger than 90°. Thus, there is a fear that the arm crowding action suddenly accelerates due to sudden rise in the target pilot pressure when the angle φ becomes the state of being larger than 90° from the state of being smaller than 90° according to the arm crowding action.

Similarly, as illustrated in FIG. 15B, in execution of arm dumping operation, the maximum pressure Pmax is set as the target pilot pressure that is the target value of the pilot pressure generated in the solenoid proportional valve 55*b* when the angle φ is smaller than 90°. Thus, there is a fear that the arm dumping action suddenly accelerates due to sudden rise in the target pilot pressure when the angle φ becomes the state of being smaller than 90° from the state of being larger than 90° according to the arm dumping action.

Thus, in the present second embodiment, when it is determined that the posture of the work device 1A is not the entry posture, transition control to change the velocity of the arm 9 according to change in the angle φ formed by the line segment Lpb and the target surface St is carried out. Whether or not execution of the transition control is possible is decided according to the setting state of a transition control execution flag Fct(n) or Fdt(n).

Figure 16:
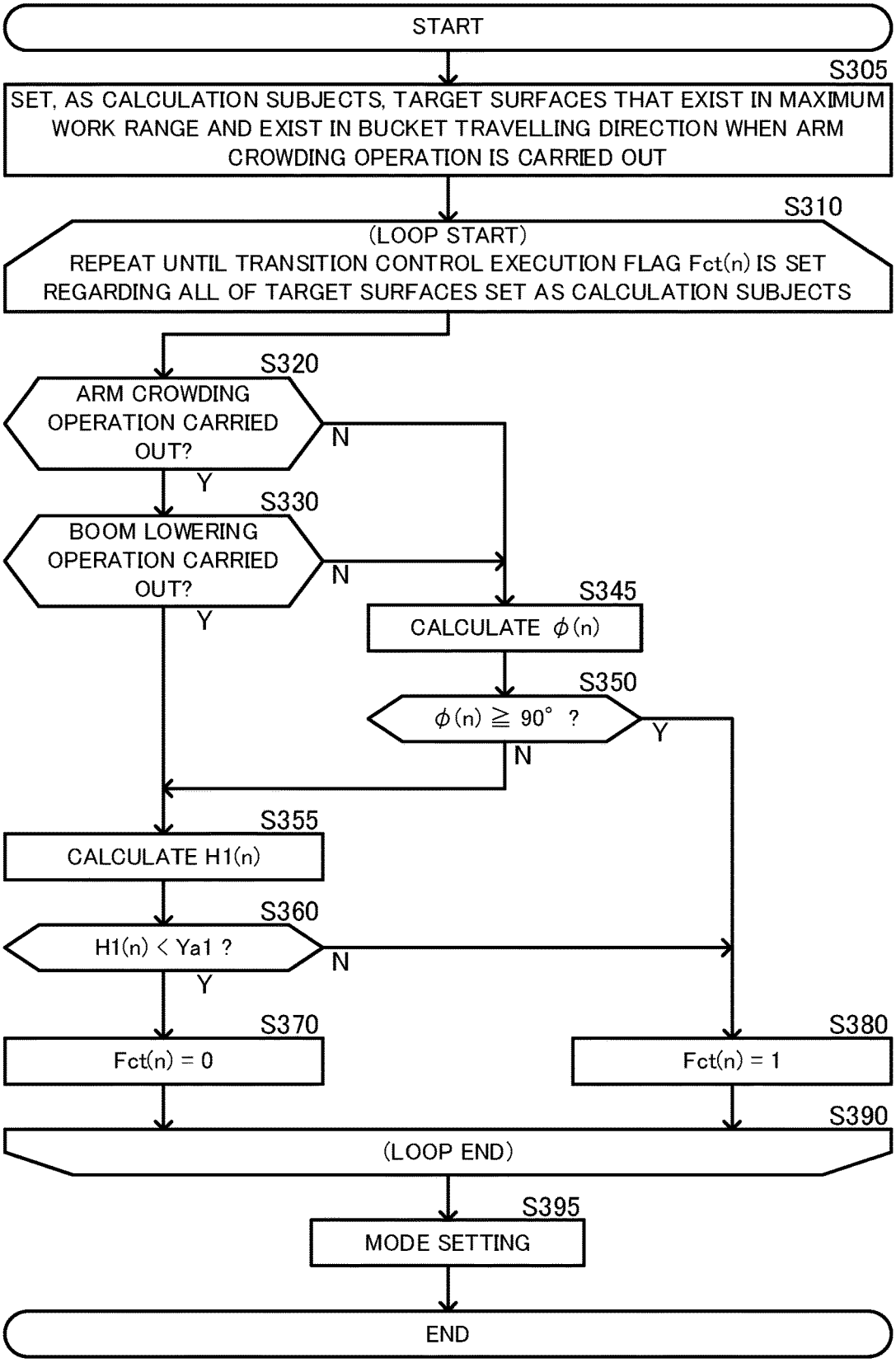
FIG. 16 is a flowchart illustrating the contents of setting processing of a transition control execution flag Fct(n) for arm crowding executed by the controller according to the second embodiment.
Figure 17:
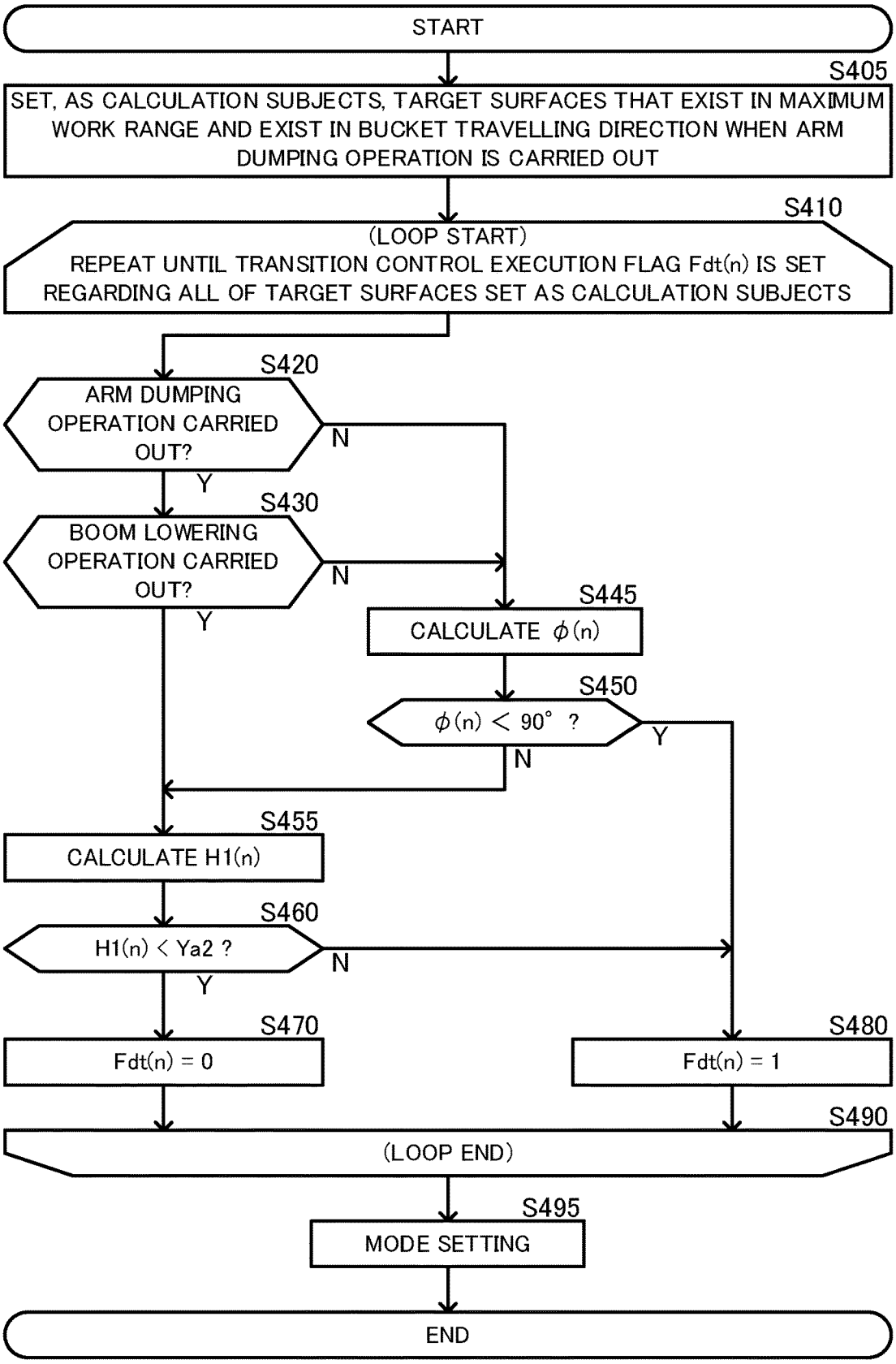
FIG. 17 is a flowchart illustrating the contents of setting processing of a transition control execution flag Fdt(n) for arm dumping executed by the controller according to the second embodiment.

FIG. 16 is a flowchart illustrating the contents of setting processing of the transition control execution flag Fct(n) for arm crowding executed by the controller 40 according to the second embodiment. FIG. 17 is a flowchart illustrating the contents of setting processing of the transition control execution flag Fdt(n) for arm dumping executed by the controller 40 according to the second embodiment. The processing of the flowcharts illustrated in FIG. 16 and FIG. 17 is started due to setting of the ground leveling control mode by a control mode changeover switch or the like that is not illustrated in the diagram, and is repeatedly executed at a predetermined control cycle after initial setting that is not illustrated in the diagram is carried out.

Steps S305, S320, S330, S345, S350, S355, and S360 illustrated in FIG. 16 are the same processing as the steps S105, S120, S130, S145, S150, S155, and S160 illustrated in FIG. 10 and therefore description thereof is omitted.

Loop processing (S310, S390) illustrated in FIG. 16 ends when a series of processing has been executed and the transition control execution flag Fct(n) has been set regarding all of the target surfaces St(n), (n=m to 0) set as calculation subjects. Upon the end of the loop processing, progress to a step S395 is made.

When it is determined in the step S350 that the angle φ(n) is equal to or larger than 90°, progress to a step S380 is made. Furthermore, when it is determined in the step S360 that the distance H1(*n*) is shorter than the threshold Ya1, progress to a step S370 is made. When it is determined that the distance H1(*n*) is equal to or longer than the threshold Ya1, progress to a step S380 is made.

In the step S370, the controller 40 sets the transition control execution flag Fct(n) to 0 (Fct(n)=0). Then, progress to the step S390 is made to end the series of processing regarding the relevant target surface St(n). In the step S380, the controller 40 sets the transition control execution flag Fct(n) to 1 (Fct(n)=1). Then, progress to the step S390 is made to end the series of processing regarding the relevant target surface St(n).

That is, the controller 40 sets the transition control execution flag Fct(n) to 1 (Fct(n)=1) when it is determined that there is no possibility that the bucket 10 enters the target surface St(n) due to arm crowding operation through the determination that the angle φ(n) is equal to or larger than 90°.

When the loop processing is completed, progress to the step S395 is made and mode setting processing is executed. In the step S395, the controller 40 determines whether or not all of the transition control execution flags Fct(n), (n=m to 0) are set to Fct(n)=1, and determines whether or not execution of the transition control is possible on the basis of the determination result. When it is determined that all of the transition control execution flags Fct(n) are not set to Fct(n)=1, i.e. when even one of the transition control execution flags Fct(n), (n=m to 0) is determined to be set to Fct(n)=0, the controller 40 sets a mode in which the transition control is not carried out. When it is determined that all of the transition control execution flags Fct(n), (n=m to 0) are set to Fct(n)=1, the controller 40 sets a mode in which the transition control is carried out. When the mode setting processing (S395) ends, the processing illustrated in the flowchart of FIG. 16 ends.

Steps S405, S420, S430, S445, S450, S455, and S460 illustrated in FIG. 17 are the same processing as the steps S205, S220, S230, S245, S250, S255, and S260 illustrated in FIG. 11 and therefore description thereof is omitted.

Loop processing (S410, S490) illustrated in FIG. 17 ends when a series of processing has been executed and the transition control execution flag Fdt(n) has been set regarding all of the target surfaces St(n), (n=0 to q) set as calculation subjects. Upon the end of the loop processing, progress to a step S495 is made.

When it is determined in the step S450 that the angle φ(n) is smaller than 90°, progress to a step S480 is made. Furthermore, when it is determined in the step S460 that the distance H1(*n*) is shorter than the threshold Ya2, progress to a step S470 is made. When it is determined that the distance H1(*n*) is equal to or longer than the threshold Ya2, progress to a step S480 is made.

In the step S470, the controller 40 sets the transition control execution flag Fdt(n) to 0 (Fdt(n)=0). Then, progress to the step S490 is made to end the series of processing regarding the relevant target surface St(n). In the step S480, the controller 40 sets the transition control execution flag Fdt(n) to 1 (Fdt(n)=1). Then, progress to the step S490 is made to end the series of processing regarding the relevant target surface St(n).

That is, the controller 40 sets the transition control execution flag Fdt(n) to 1 (Fdt(n)=1) when it is determined that there is no possibility that the bucket 10 enters the target surface St(n) due to arm dumping operation through the determination that the angle φ(n) is smaller than 90°.

When the loop processing is completed, progress to the step S495 is made and mode setting processing is executed. In the step S495, the controller 40 determines whether or not all of the transition control execution flags Fdt(n), (n=0 to q) are set to Fdt(n)=1, and determines whether or not execution of the transition control is possible on the basis of the determination result. When it is determined that all of the transition control execution flags Fdt(n) are not set to Fdt(n)=1, i.e. when even one of the transition control execution flags Fdt(n), (n=0 to q) is determined to be set to Fdt(n)=0, the controller 40 sets a mode in which the transition control is not carried out. When it is determined that all of the transition control execution flags Fdt(n), (n=0 to q) are set to Fdt(n)=1, the controller 40 sets a mode in which the transition control is carried out. When the mode setting processing (S495) ends, the processing illustrated in the flowchart of FIG. 17 ends.

Figure 18:
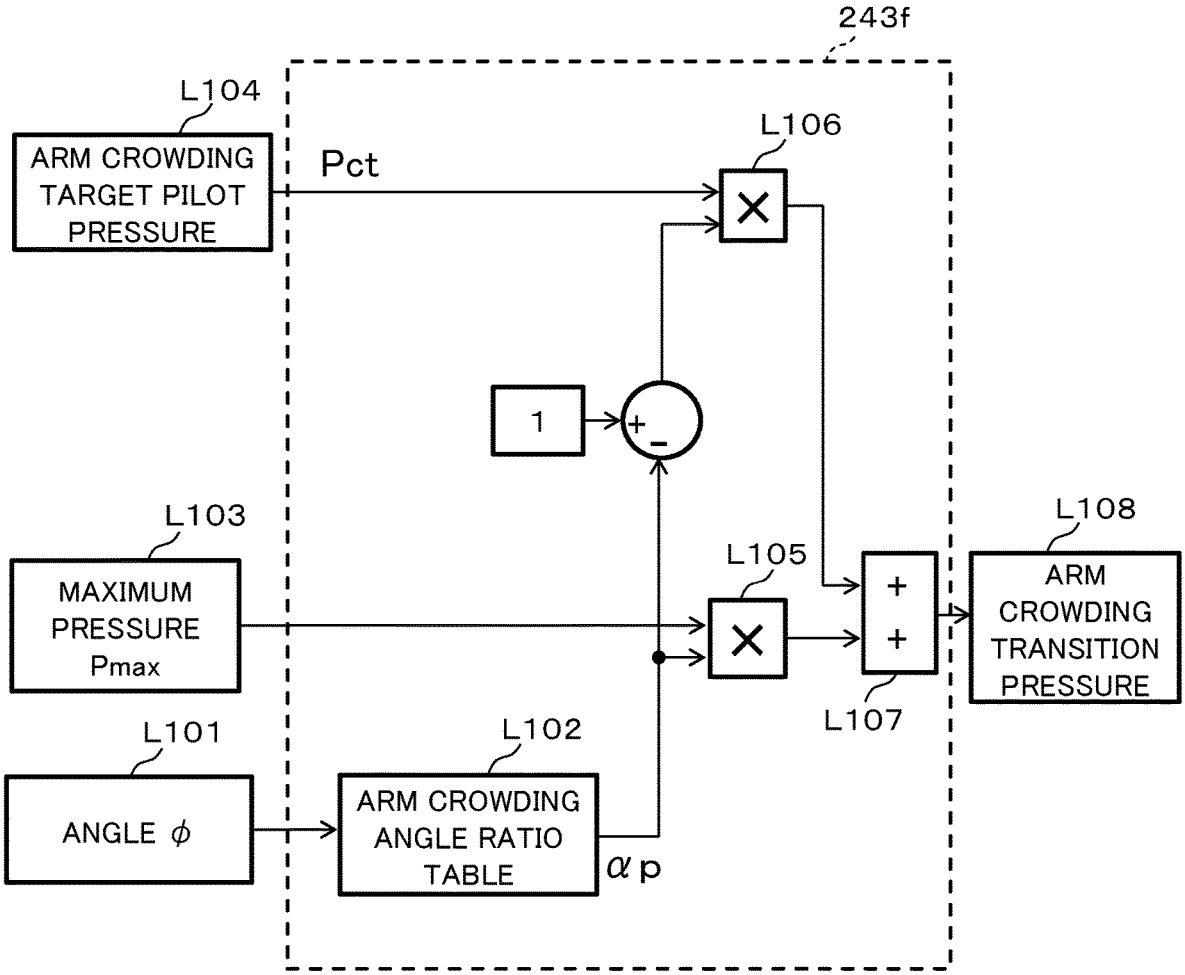
FIG. 18 is a control block diagram of an intervention deactivation calculating section according to the second embodiment and illustrates calculation of an arm crowding transition pressure.

The transition control carried out by an intervention deactivation calculating section 243*f* according to the second embodiment will be described in detail with reference to FIG. 18 to FIG. 21B. FIG. 18 is a control block diagram of the intervention deactivation calculating section 243*f* and illustrates calculation of an arm crowding transition pressure. As illustrated in FIG. 18, the angle φ(n) that is calculated in the posture calculating section 43*b* and is formed by the line segment Lpb and the target surface St(n) is input to the intervention deactivation calculating section 243*f* (L101). Then, the intervention deactivation calculating section 243*f* refers to an arm crowding angle ratio table and outputs a maximum pressure ratio αp on the basis of the angle φ (L102). The arm crowding angle ratio table is a table in which the angle φ and the maximum pressure ratio αp are associated with each other and is stored in the storing device of the controller 40.

Figure 19A:
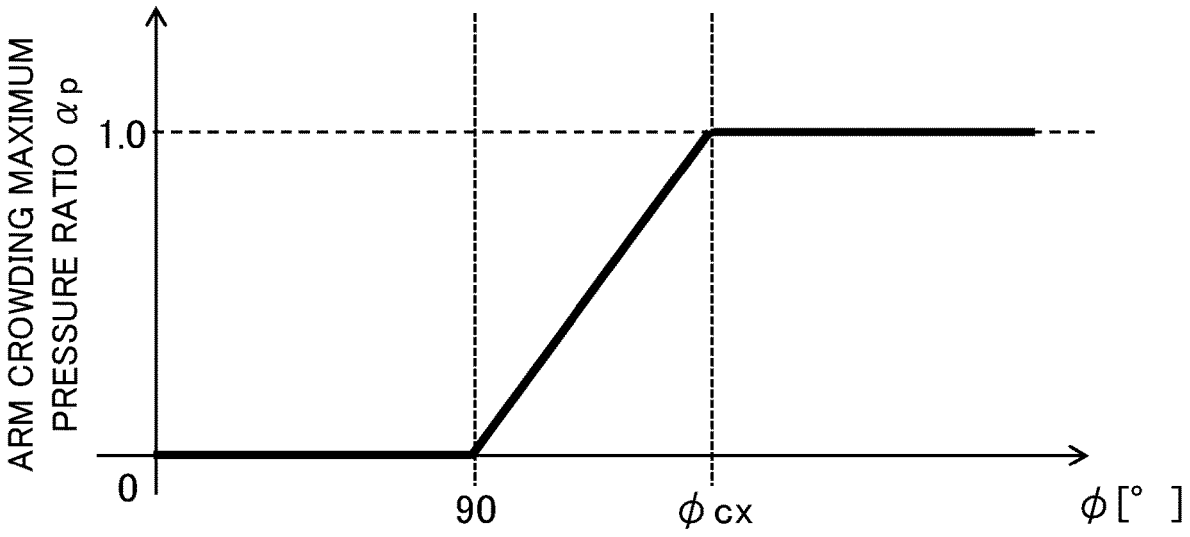
FIG. 19A is a diagram illustrating an arm crowding angle ratio table.

FIG. 19A is a diagram illustrating the arm crowding angle ratio table. As illustrated in FIG. 19A, in the arm crowding angle ratio table, a characteristic is stored in which the maximum pressure ratio αp=0.0 when the angle φ is smaller than 90°, the maximum pressure ratio αp=1.0 when the angle φ is equal to or larger than a predetermined angle φcx, and in a range in which the angle φ is equal to or larger than 90° and is smaller than φcx, the larger the angle φ becomes, the higher the maximum pressure ratio αp becomes. As the predetermined angle φcx, a value that is larger than 90° and is smaller than 180° is set. The maximum pressure ratio αp is a function that monotonically increases from 0 (zero) to 1 in response to increase in the angle φ in the range in which the angle φ is equal to or larger than 90° and is smaller than φcx.

As illustrated in FIG. 18, the intervention deactivation calculating section 243*f* acquires the maximum pressure Pmax from the storing device (L103) and multiples the maximum pressure ratio αp by the maximum pressure Pmax (L105). A target pilot pressure Pct calculated in the target pilot pressure calculating section 43*e* is input to the intervention deactivation calculating section 243*f* (L104). Then, the intervention deactivation calculating section 243*f* multiplies the arm crowding target pilot pressure Pct that is the target value of the pilot pressure generated in the solenoid proportional valve 55*a* by a value (1−αp) obtained by reducing the maximum pressure ratio αp from 1 (L106). (1−αp) is a function that monotonically decreases from 1 to 0 (zero) in response to increase in the angle φ in the range in which the angle φ is equal to or larger than 90° and is smaller than φcx.

The intervention deactivation calculating section 243*f* adds the multiplication value of the arm crowding target pilot pressure Pct and (1−αp) to the multiplication value of the maximum pressure Pmax and αp (L107) and outputs the arm crowding transition pressure that is the calculation result thereof as the target pilot pressure (L108).

Figure 19B:
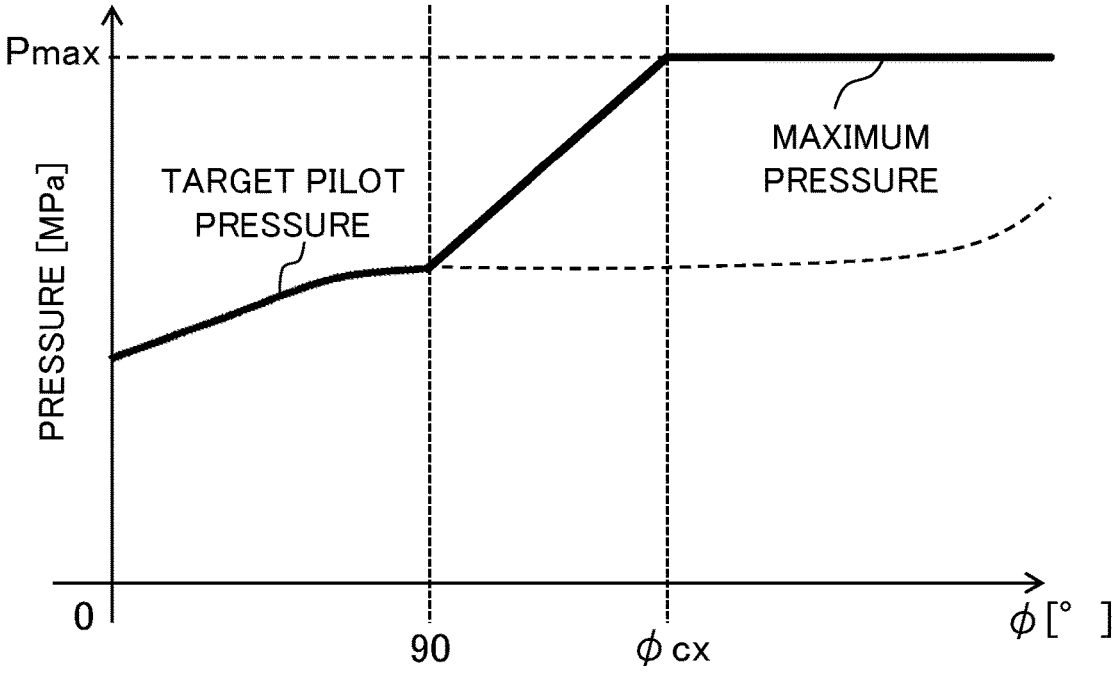
FIG. 19B is a diagram illustrating the arm crowding transition pressure.

FIG. 19B is a diagram illustrating the arm crowding transition pressure. The intervention deactivation calculating section 243*f* calculates the transition pressure according to the angle φ as described above and outputs the transition pressure as the target pilot pressure. Due to this, as illustrated in FIG. 19B, in the range in which the angle φ formed by the line segment Lpb and the target surface St(n) is equal to or larger than 90° and is smaller than φcx, the target pilot pressure (transition pressure) gradually becomes larger as the angle φ becomes larger. When the angle φ becomes equal to or larger than φcx, the target pilot pressure becomes the maximum pressure Pmax. Due to this, the velocity of the arm crowding is prevented from suddenly changing when a transition is made from the state in which the deceleration control is carried out to the state in which the deceleration control is not carried out due to change in the angle φ.

Figure 20:
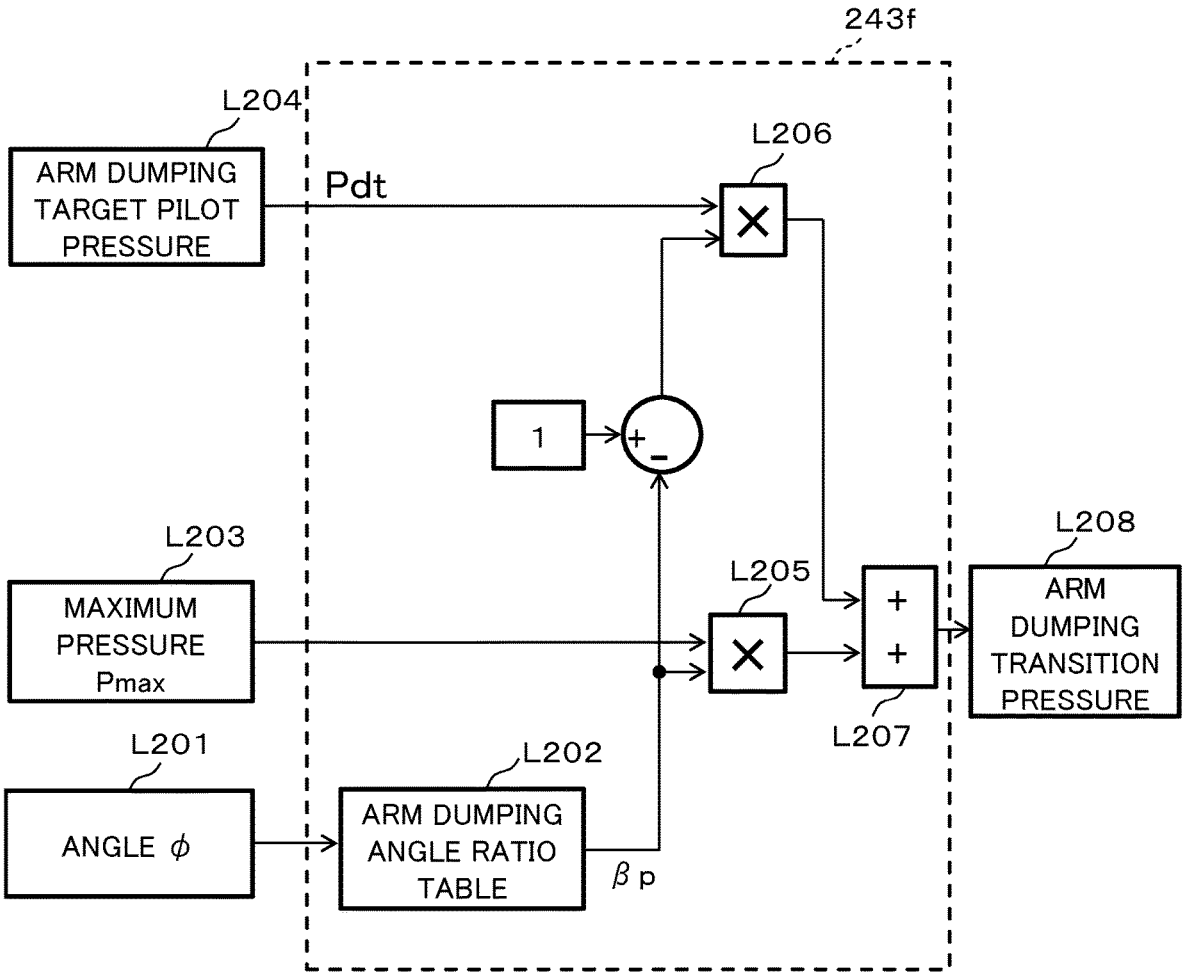
FIG. 20 is a control block diagram of the intervention deactivation calculating section according to the second embodiment and illustrates calculation of an arm dumping transition pressure.

FIG. 20 is a control block diagram of the intervention deactivation calculating section 243*f* and illustrates calculation of an arm dumping transition pressure. As illustrated in FIG. 20, the angle φ(n) that is calculated in the posture calculating section 43*b* and is formed by the line segment Lpb and the target surface St(n) is input to the intervention deactivation calculating section 243*f* (L201). Then, the intervention deactivation calculating section 243*f* refers to an arm dumping angle ratio table and outputs a maximum pressure ratio βp on the basis of the angle φ (L202). The arm dumping angle ratio table is a table in which the angle φ and the maximum pressure ratio βp are associated with each other and is stored in the storing device of the controller 40.

Figure 21A:
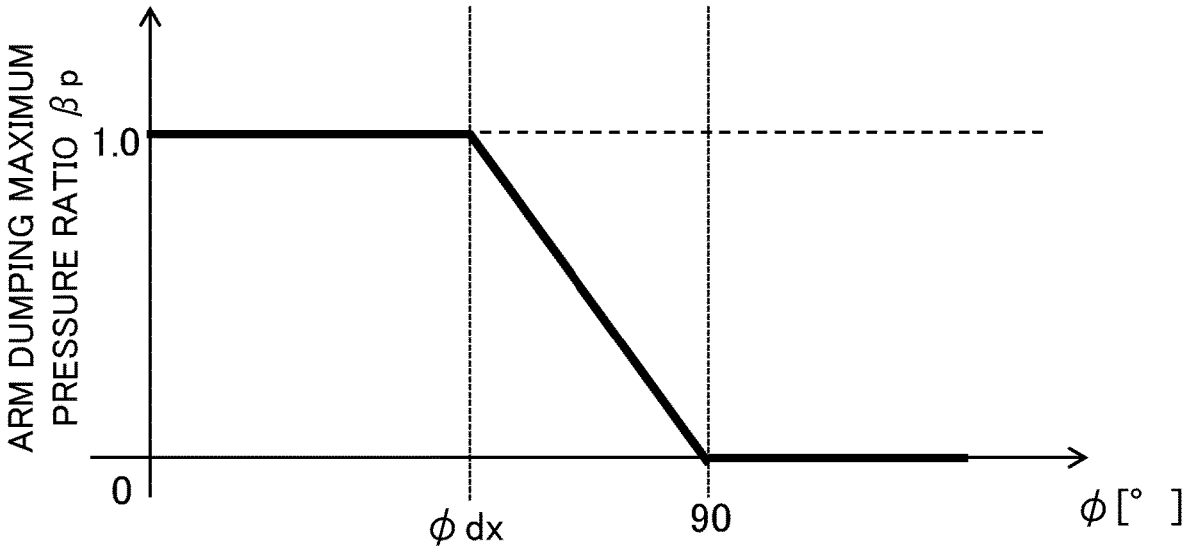
FIG. 21A is a diagram illustrating an arm dumping angle ratio table.

FIG. 21A is a diagram illustrating the arm dumping angle ratio table. As illustrated in FIG. 21A, in the arm dumping angle ratio table, a characteristic is stored in which the maximum pressure ratio βp=0.0 when the angle φ is equal to or larger than 90°, the maximum pressure ratio βp=1.0 when the angle φ is smaller than a predetermined angle φdx, and in a range in which the angle φ is equal to or larger than φdx and is smaller than 90°, the smaller the angle φ becomes, the higher the maximum pressure ratio βp becomes. As the predetermined angle φdx, a value that is larger than 0° and is smaller than 90° is set. The maximum pressure ratio βp is a function that monotonically decreases from 1 to 0 (zero) in response to increase in the angle φ in the range in which the angle φ is equal to or larger than φdx and is smaller than 90°.

As illustrated in FIG. 20, the intervention deactivation calculating section 243*f* acquires the maximum pressure Pmax from the storing device (L203) and multiples the maximum pressure ratio βp by the maximum pressure Pmax (L205). A target pilot pressure Pdt calculated in the target pilot pressure calculating section 43*e* is input to the intervention deactivation calculating section 243*f* (L204). Then, the intervention deactivation calculating section 243*f* multiplies the arm dumping target pilot pressure Pdt that is the target value of the pilot pressure generated in the solenoid proportional valve 55*b* by a value (1−βp) obtained by reducing the maximum pressure ratio βp from 1 (L206). (1−βp) is a function that monotonically increases from 0 (zero) to 1 in response to increase in the angle φ in the range in which the angle φ is equal to or larger than φdx and is smaller than 90°.

The intervention deactivation calculating section 243*f* adds the multiplication value of the arm dumping target pilot pressure Pdt and (1−βp) to the multiplication value of the maximum pressure Pmax and βp (L207) and outputs the arm dumping transition pressure that is the calculation result thereof as the target pilot pressure (L208).

Figure 21B:
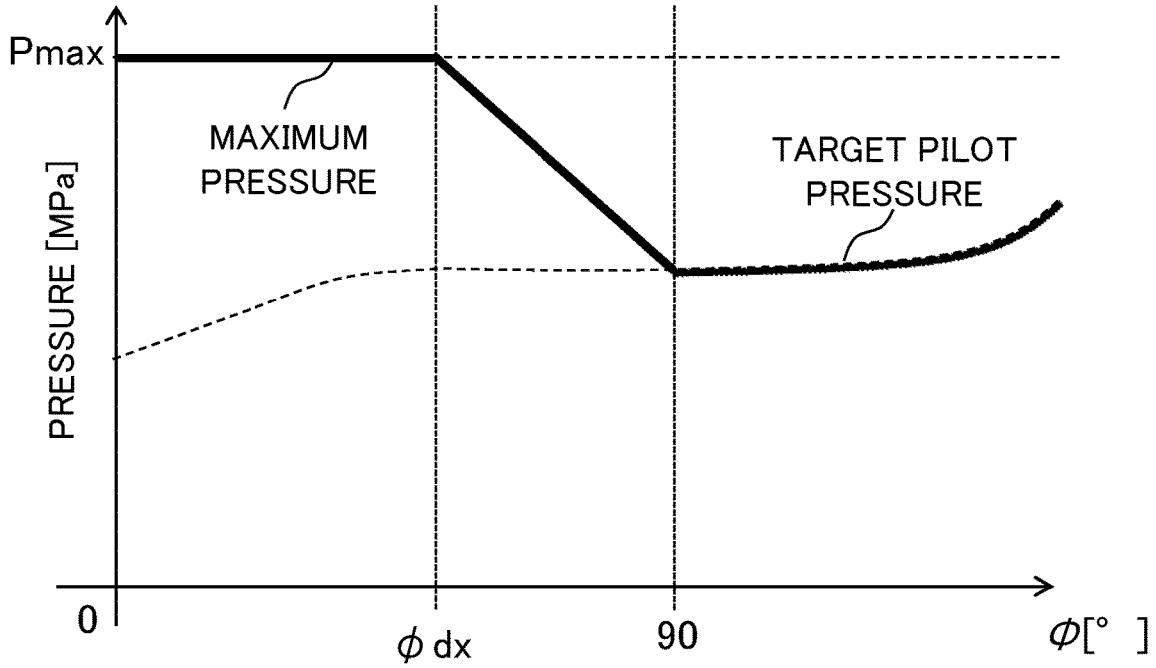
FIG. 21B is a diagram illustrating the arm dumping transition pressure.

FIG. 21B is a diagram illustrating the arm dumping transition pressure. The intervention deactivation calculating section 243*f* calculates the transition pressure according to the angle φ as described above and outputs the transition pressure as the target pilot pressure. Due to this, as illustrated in FIG. 21B, in the range in which the angle φ formed by the line segment Lpb and the target surface St(n) is equal to or larger than φdx and is smaller than 90°, the target pilot pressure (transition pressure) gradually becomes larger as the angle φ becomes smaller. When the angle φ becomes smaller than φdx, the target pilot pressure becomes the maximum pressure Pmax. Due to this, the velocity of the arm dumping is prevented from suddenly changing when a transition is made from the state in which the deceleration control is carried out to the state in which the deceleration control is not carried out due to change in the angle φ.

According to such a second embodiment, when it is determined that the posture of the work device 1A is not the entry posture due to action of the arm 9 and crossing 90° by the angle φ and the deceleration control is deactivated, the velocity of the arm 9 can be changed by gradually increasing the target pilot pressure according to change in the angle φ. That is, it is possible to prevent the velocity of the arm 9 from suddenly changing when a transition is made from the state in which the deceleration control is carried out to the state in which the deceleration control is not carried out due to change in the angle φ.

The following modification examples are also within the range of the present invention and it is also possible to combine a configuration shown in the modification example and a configuration explained in the above-described embodiment and to combine configurations to be explained in the following different modification examples with each other.

Modification Example 1

In the above-described embodiment, explanation has been made about the example in which the magnitude relation between the pin-to-target surface distance H2(*n*) and the pin-to-bucket distance Dpb is compared with each other as it is and the deceleration control of the arm 9 is not carried out when the distance H2(*n*) is equal to or longer than the distance Dpb (see the step S140 in FIG. 10 and the step S240 in FIG. 11). However, the present invention is not limited thereto. The comparison may be carried out after correction is made through adding a margin amount ΔD to the distance Dpb. That is, the deceleration control of the arm 9 may be kept from being carried out when the distance H2(*n*) is equal to or longer than a distance Dpb' (=Dpb+ΔD) after the correction. Furthermore, the comparison may be carried out after correction is made through subtracting a margin amount ΔH from the distance H2. That is, the deceleration control of the arm 9 may be kept from being carried out when a distance H2(*n*)' (=H2(*n*)−ΔH) after the correction is equal to or longer than the distance Dpb. By allowing the distance Dpb or H2(*n*) to have the margin amount ΔD or ΔH, entry of the tip of the bucket 10 into the target surface St can be prevented more effectively.

Modification Example 2

In the above-described embodiment, explanation has been made about the example in which the controller 40 determines that there is no possibility that the bucket 10 enters the target surface St when operation of the arm 9 is carried out in the case in which the controller 40 calculates the pin-to-bucket distance Dpb and calculates the pin-to-target surface distance H2 and determines whether or not the posture of the work device 1A is the entry posture on the basis of the pin-to-bucket distance Dpb and the pin-to-target surface distance H2 and it is determined that the posture of the work device 1A is not the entry posture or in the case in which the controller 40 calculates the angle φ and determines whether or not the posture of the work device 1A is the entry posture on the basis of the angle φ and it is determined that the posture of the work device 1A is not the entry posture. Furthermore, in the above-described embodiment, explanation has been made about the example in which the controller 40 determines that there is a possibility that the bucket 10 enters the target surface St when operation of the arm 9 is carried out in the case in which the controller 40 determines whether or not the posture of the work device 1A is the entry posture on the basis of the pin-to-bucket distance Dpb and the pin-to-target surface distance H2 and it is determined that the posture of the work device 1A is the entry posture and the controller 40 determines whether or not the posture of the work device 1A is the entry posture on the basis of the angle φ and it is determined that the posture of the work device 1A is the entry posture. However, the present invention is not limited thereto. For example, the steps S145 and S150 in FIG. 10 and the steps S245 and S250 in FIG. 11 may be omitted. In this case, the determination of whether or not there is a possibility that the bucket 10 enters the target surface St on the basis of whether or not the tip part of the bucket 10 moves in such a direction as to get closer to the target surface St due to arm operation is not carried out. Therefore, even when the arm 9 makes action in such a direction that the tip part of the bucket 10 gets farther away from the target surface St, the deceleration control of the arm 9 is carried out when the pin-to-target surface distance H2(*n*) is shorter than the pin-to-bucket distance Dpb and the bucket-to-target surface distance H1(*n*) is shorter than the threshold Ya1. However, the deceleration control of the arm 9 is not carried out when the pin-to-target surface distance H2(*n*) is equal to or longer than the pin-to-bucket distance Dpb. Therefore, improvement in the work efficiency can be intended. Similarly, the steps S135 and S140 in FIG. 10 and the steps S235 and S240 in FIG. 11 may be omitted. In this case, the deceleration control of the arm 9 is not carried out when it is determined that there is no possibility that the bucket 10 enters the target surface St due to arm operation in the step S150 and the step S250. Therefore, improvement in the work efficiency can be intended.

Modification Example 3

In the above-described embodiment, explanation has been made about the example in which, when combined operation of lowering operation of the boom 8 and operation of the arm 9 by the operator is being carried out, the deceleration control of the arm 9 is carried out even when the posture of the work device 1A is not the entry posture (for example, when the distance H2 is equal to or longer than the distance Dpb). However, the present invention is not limited thereto. For example, in the step S130 in FIG. 10 and the step S230 in FIG. 11, it may be determined whether or not a command of boom lowering operation from the controller 40 is output.

In the hydraulic excavator 101, a solenoid proportional valve and a shuttle valve with a configuration similar to the solenoid proportional valve 54*a* and the shuttle valve 82*a* disposed in the hydraulic circuit on the boom raising side, illustrated in FIG. 3, are disposed in the hydraulic circuit on the boom lowering side in some cases. In this case, boom lowering action can be automatically controlled by this solenoid proportional valve. The automatic control of boom lowering action is carried out when a boom lowering pressure increase function is set valid by a mode setting switch. By controlling the solenoid proportional valve disposed for the boom lowering pressure increase function by the controller 40, a control pressure (second control signal) higher than an operation pressure (first control signal) for boom lowering operation by the operator can be generated and be made to act on the hydraulic drive part 150*b* of the flow control valve 15*a*.

In the present modification example 3, in the step S130 in FIG. 10, for example, it is determined whether or not the boom lowering pressure increase function is set valid and the condition under which the boom lowering pressure increase function is exerted holds. Furthermore, when, in the step S130, the boom lowering pressure increase function is set valid and the condition under which the boom lowering pressure increase function is exerted holds, it is determined that boom lowering operation by the controller 40 is being carried out, and progress to the step S155 is made. When the boom lowering pressure increase function is set invalid or when the boom lowering pressure increase function is set valid but the condition under which the boom lowering pressure increase function is exerted does not hold, it is determined that boom lowering operation by the controller 40 is not being carried out, and progress to the step S135 is made. The same processing can be employed also regarding the processing of the step S230 in FIG. 11.

Although the embodiments of the present invention have been described above, the above-described embodiments merely show part of application examples of the present invention and do not intend to limit the technical range of the present invention to specific configurations of the above-described embodiments.

DESCRIPTION OF REFERENCE CHARACTERS

1A: Work device
1B: Machine body
8: Boom
9: Arm
10: Bucket (work equipment)
14: GNSS antenna (position sensor)
30 to 33: Angle sensor (posture sensor)
40: Controller
44, 45: Operation device
92: Arm pin
101, 201: Hydraulic excavator (work machine)
St: Target surface
H1: Bucket-to-target surface distance (work equipment-to-target surface distance)
H2: Pin-to-target surface distance
Dpb: Pin-to-bucket distance (pin-to-work equipment distance)
Lpb: Line segment
φ: Angle (angle formed by line segment and target surface)

The invention claimed is:

1. A work machine comprising: a machine body; an articulated work device that has a boom, an arm, and work equipment and is attached to the machine body; an operation device that operates the machine body and the work device; a position sensor that senses a position of the machine body; a posture sensor that senses posture of the work device; and a controller having an input interface, an output interface, a CPU, and memory that sets a target surface, and is configured to calculate a work equipment-to-target surface distance that is a distance from the work equipment to the target surface on a basis of the position of the machine body sensed by the position sensor and the posture of the work device sensed by the posture sensor, and control the boom and carry out deceleration control to decelerate the arm to keep the work equipment from excavating ground beyond the target surface when operation of the arm is carried out by the operation device and the work equipment-to-target surface distance has become shorter than a predetermined distance, wherein the controller is configured to calculate an angle between a predetermined straight line parallel to a line segment that links an arm pin, the arm pin joining the boom and the arm, with the work equipment and the target surface on the side of the machine body relative to the predetermined straight line when the predetermined straight line is located on the target surface, on a basis of the target surface that is set, the position of the machine body sensed by the position sensor, and the posture of the work device sensed by the posture sensor, the controller is configured to determine that the posture of the work device is not an entry posture at which the work equipment enters the target surface when the angle between the predetermined straight line and the target surface is equal to or larger than 90° when a crowding operation of the arm is carried out, the controller is configured to determine that the posture of the work device is not the entry posture when the angle between the predetermined straight line and the target surface is smaller than 90° when a dumping operation of the arm is carried out, and the controller is configured not to carry out the deceleration control when the work equipment-to-target surface distance is shorter than the predetermined distance in a case in which it is determined that the posture of the work device is not the entry posture, wherein the controller is further configured to gradually change velocity of the arm upon transitioning from a state in which the deceleration control is carried out to a state in which the deceleration control is not carried out according to change in the angle formed by the line segment and the target surface being larger than 90° when a crowding operation of the arm is carried out and it is determined that the posture of the work device is not the entry posture, and gradually change velocity of the arm upon transitioning from a state in which the deceleration control is carried out to a state in which the deceleration control is not carried out according to change in the angle formed by the line segment and the target surface being smaller than 90° when a dumping operation of the arm is carried out and it is determined that the posture of the work device is not the entry posture.

2. The work machine according to claim 1, wherein the controller is configured to calculate a pin-to-work equipment distance that is a distance from an arm pin, the arm pin joining the boom and the arm, to the work equipment on a basis of the signal from the posture sensor, calculate a pin-to-target surface distance that is a distance from the arm pin to the target surface on a basis of the target surface that is set and the signals from the position sensor and the posture sensor, and determine whether or not the posture of the work device is the entry posture on a basis of the pin-to-work equipment distance and the pin-to-target surface distance.

3. The work machine according to claim 1, wherein the controller is configured to determine whether or not there is a possibility that the work equipment enters the target surface when operation of the arm is carried out regarding target surfaces that are target surfaces existing in a work range of the work equipment and exist in a travelling direction of the work equipment when the operation of the arm is carried out in a plurality of the target surface that are set.

4. The work machine according to claim 1, wherein the controller is configured to carry out the deceleration control to decelerate the arm even in a case in which the posture of the work device is not the entry posture when combined operation of a lowering operation of the boom and operation of the arm is being carried out.

5. The work machine according to claim 1, wherein the controller is configured to determine that there is no possibility that the work equipment enters the target surface when operation of the arm is carried out in a case in which the controller calculates a pin-to-work equipment distance that is a distance from an arm pin, the arm pin joining the boom and the arm, to the work equipment on a basis of the signal from the posture sensor, and calculates a pin-to-target surface distance that is a distance from the arm pin to the target surface on a basis of the target surface that is set and the signals from the position sensor and the posture sensor, and determines whether or not the posture of the work device is the entry posture on a basis of the pin-to-work equipment distance and the pin-to-target surface distance, and it is determined that the posture of the work device is not the entry posture, or in a case in which the controller calculates an angle formed by a line segment, the line segment linking the arm pin with the work equipment, and the target surface on a basis of the target surface that is set and the signals from the position sensor and the posture sensor and determines whether or not the posture of the work device is the entry posture on a basis of the angle formed by the line segment and the target surface, and it is determined that the posture of the work device is not the entry posture, and determine that there is a possibility that the work equipment enters the target surface when operation of the arm is carried out in a case in which the controller determines whether or not the posture of the work device is the entry posture on a basis of the pin-to-work equipment distance and the pin-to-target surface distance and it is determined that the posture of the work device is the entry posture and the controller determines whether or not the posture of the work device is the entry posture on a basis of the angle formed by the line segment and the target surface and it is determined that the posture of the work device is the entry posture.

* * * * *